US010702786B2

(12) United States Patent
Hugill et al.

(10) Patent No.: US 10,702,786 B2
(45) Date of Patent: Jul. 7, 2020

(54) NOISE GENERATION DEVICE

(71) Applicant: B.L. TECH LIMITED, Auckland (NZ)

(72) Inventors: Mark Daniel Hugill, Auckland (NZ); Shane Ross Hugill, Howick (NZ)

( * ) Notice: Subject to any disclaimer, the term of this patent is extended or adjusted under 35 U.S.C. 154(b) by 144 days.

(21) Appl. No.: 15/559,087

(22) PCT Filed: Mar. 18, 2016

(86) PCT No.: PCT/NZ2016/050042
§ 371 (c)(1),
(2) Date: Sep. 18, 2017

(87) PCT Pub. No.: WO2016/148586
PCT Pub. Date: Sep. 22, 2016

(65) Prior Publication Data

US 2018/0071645 A1 Mar. 15, 2018

(30) Foreign Application Priority Data

Mar. 18, 2015 (NZ) ..... 705968

(51) Int. Cl.

| | |
|---|---|
| ***A63H 5/04*** | (2006.01) |
| ***A63H 5/00*** | (2006.01) |
| ***F41A 33/04*** | (2006.01) |
| ***G10K 15/04*** | (2006.01) |
| ***G10K 15/06*** | (2006.01) |

(52) U.S. Cl.
CPC ..... *A63H 5/00* (2013.01); *A63H 5/04* (2013.01); *F41A 33/04* (2013.01); *G10K 15/04* (2013.01); *G10K 15/043* (2013.01); *G10K 15/06* (2013.01)

(58) Field of Classification Search
CPC .. F41A 33/00; F41A 33/04; A63F 5/00; A63F 5/04; G10K 15/04; A63H 5/00; A63H 5/04
See application file for complete search history.

(56) References Cited

U.S. PATENT DOCUMENTS

| | | | |
|---|---|---|---|
| 2,836,919 | A | 6/1958 | Du Bois |
| 3,897,195 | A | 7/1975 | Finch |
| 4,654,008 | A | 3/1987 | Elmore |
| 5,180,878 | A | 1/1993 | Denchfield |
| 5,646,363 | A | 7/1997 | Denchfield |
| 5,942,715 | A | 8/1999 | Denchfield et al. |

(Continued)

FOREIGN PATENT DOCUMENTS

| | | |
|---|---|---|
| WO | 9635920 | 11/1996 |

*Primary Examiner* — Omkar A Deodhar
(74) *Attorney, Agent, or Firm* — Dann, Dorfman, Herrell and Skillman, P.C.

(57) ABSTRACT

A noise generation device comprising: a housing defining a chamber, the housing comprising a wall member moveable between a sealed position and an open position, wherein in the sealed position the chamber is fluidly sealed and in the open position the chamber is open; an injection assembly for injecting combustible material into the chamber; and a triggering assembly for triggering the combustible material to combust inside the chamber to generate a noise, wherein the noise generation device is configured such that the moveable wall member moves from the sealed position to the open position on combustion of the material inside the chamber to allow material to exit the chamber. A gun attachment and a simulation weapon are also disclosed.

19 Claims, 15 Drawing Sheets

(56) References Cited

U.S. PATENT DOCUMENTS

| | | | | |
|---|---|---|---|---|
| 7,927,102 | B2 | 4/2011 | Jones et al. | |
| 8,973,361 | B2 | 3/2015 | Ruegg | |
| 2003/0116100 | A1 | 6/2003 | Cullen | |
| 2011/0180020 | A1* | 7/2011 | Ruegg | F28G 7/00 122/379 |

* cited by examiner

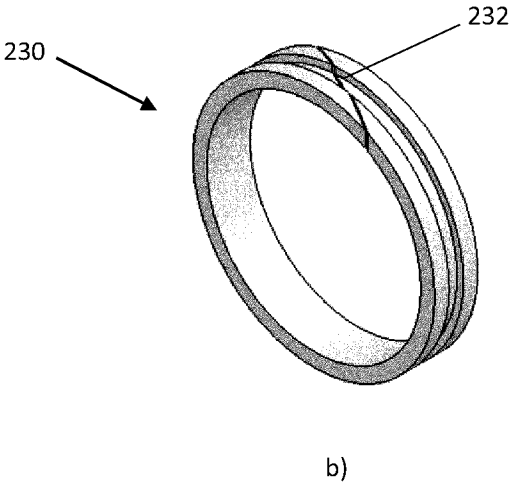
b)
Figure 8
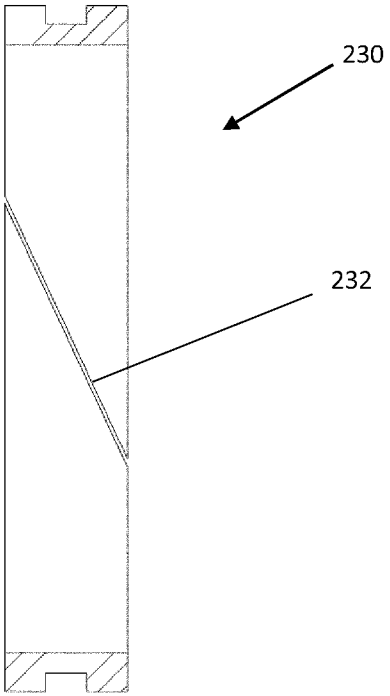
a)

NOISE GENERATION DEVICE

FIELD OF INVENTION

The invention relates to the field of noise generation devices. In particular the invention relates to a device that is operable to simulate the sound of a gun.

BACKGROUND TO THE INVENTION

In a variety of situations it is desirable to generate a noise, and in particular a loud noise.

For example, the simulation of the noise of a gun may be desirable where guns are used that do not fire ammunition or live rounds and therefore do not generate the type of sounds that are commonly associated with 'real' guns, e.g. firearms. Recreational combat sports such as airsoft, paintball and laser tag all involve the use of guns. However the guns do not generate noises that are similar to those generated with live round weapons. Participants in such sports are often seeking a safe experience that simulates real warfare as far as possible, including the noise made by the weapons used.

Armed forces often train using simulation weapons or with real weapons but using blank ammunition. Training aims to replicate real warfare as closely as possible to ensure soldiers are prepared should a genuine conflict arise. It is therefore desirable for soldiers to be able to train using weapons that simulate real gun noises while enabling the use of simulation weapons or blank ammunition.

There may also be circumstances in which the simulation of a gun noise is desirable when using other types of weapons such as air rifles.

In the above examples it is generally desirable for the device that generates a simulated gun noise to form part of the recreation/simulation weapon (e.g. an airsoft gun), or to be easily connectable to it and be portable along with the weapon. This ensures the noise generated by the device emanates from as close to the weapon as possible, thus creating heightened realism.

Drama productions often need to simulate gun noises, for example on a movie set, TV production or theatre production. In the case of movies or TV such noises can be added to a soundtrack in post-production but in some cases the realism of an authentic sounding noise generated at the right moment in the action may be desirable. In some cases it may be acceptable for a gun noise to be generated by a device not visible to the audience (i.e. off-camera or off-stage) but in other cases the realism of a gun that generates the noise itself may be required.

There is therefore a need for a device that can simulate a gun noise, whether as a standalone device or a device that can be mounted on a real or simulation gun or other weapon.

Aside from the generation of a noise for the purposes of simulating a gun, there are many other circumstances in which a loud noise may be required. For example, in simulated warfare, there may be many other sources of loud noises which are desirable to replicate, namely explosions caused by grenades, bombs, claymores, mines, improvised explosive devices (IEDs) and the like. In non-warfare related circumstances, it may be desirable to generate loud noises as part of a show, for example to replicate or supplement pyrotechnics. Additionally, bird scarers are devices that generate loud noises to scare birds (or other wildlife). For such circumstances a portable device able to generate loud noises safely would be desirable.

Prior art noise generation devices suffer from a number of drawbacks that mean they are not able to meet at least some of the needs identified above. Some noise generating devices exist that create noise by igniting a combustible material such as acetylene in a mixture with oxygen. An example is described in US patent publication no. 2009/0241794. This and other kinds of device operating on a similar principle require the use of large hoses to supply the combustible material from a gas tank external to the device to the combustion chamber. They also tend to be reasonably large. As a result, their portability is limited. Furthermore, the noise created is not akin to a gunshot.

Some prior art bird scarers use LPG as a combustible material to create a loud noise. Again, such devices are large and cumbersome, require the supply of the LPG through a hose from an external tank and are not capable of creating loud noises in rapid succession.

Conventional noise generation devices are not configured for fixing to a gun, nor for generating a realistic gun fire noise at a time that can be synchronised with the firing of the gun, nor generating gun fire noises at a high rate, for example the rate that would be expected from the firing of a gun.

It is therefore an object of the invention to provide an improved noise generation device, particularly a noise generation device that addresses at least some of the needs identified above. Alternatively, it is an object of the invention to at least provide the public with a useful choice.

SUMMARY OF THE INVENTION

Preferred aspects of the invention are set forth in the appended claims. Particular embodiments are described below in non-limiting terms.

According to a first embodiment of the invention, there is provided a noise generation device comprising:

- a housing defining a chamber, the housing comprising a wall member moveable between a sealed position and an open position, wherein in the sealed position the chamber is fluidly sealed and in the open position the chamber is open;
- means for injecting combustible material into the chamber;
- means for triggering the combustible material to combust inside the chamber to generate a noise,
- wherein the noise generation device is configured such that the moveable wall member moves from the sealed position to the open position on combustion of the material inside the chamber to allow material to exit the chamber.

Preferably, the combustion of the material causes the moveable wall member to move from the sealed position to the open position. More preferably, combusting material pushes the moveable wall member to move from the sealed position to the open position. In some embodiments, the moveable wall member may comprise an internal surface against which combusting material is able to apply pressure to move the moveable wall member from the sealed to open position.

Preferably, the noise generation device comprises means for moving the moveable wall member back to the sealed position from the open position. In some embodiments, the noise generation device comprises a return mechanism to move the moveable wall member back to the sealed position from the open position.

The means for moving the moveable wall member back to the sealed position from the open position may comprise a spring configured to compress when the moveable wall member is in the open position and to expand to push the moveable wall member into the sealed position.

In some embodiments, the means for moving the moveable wall member back to the sealed position from the open position may further comprise at least two magnetic members capable of magnetic attachment to attract the moveable wall member into the sealed position. The magnetic members may be operable to hold the moveable wall member in the sealed position.

It will be understood that the term "magnetic" where used in this specification refers to either exhibiting the properties of a magnet or being capable of being attracted to a magnet. That is, the term encompasses both magnetised materials (including permanent and temporary magnets) that produce a magnetic field and materials that are attracted to such magnetised materials, typically ferromagnetic or ferrimagnetic materials such as iron and steel. It will further be understood that for two magnetic members to be capable of magnetic attachment, one or both of the magnetic members needs to be magnetised.

In a preferred embodiment of the invention, the moveable wall member comprises a sleeve member adapted to slide longitudinally along a sleeve guide between the sealed and open positions.

Preferably, the noise generation device comprises a body portion spaced apart from the sleeve guide and attached thereto by one or more spacer elements, the sleeve abutting against the body portion and spanning the space between the body portion and sleeve guide when in the sealed position such that the chamber is defined at least by the sleeve guide, sleeve and body portion. More preferably, the sleeve is slideable along the sleeve guide between the sealed position, in which the sleeve abuts against the body portion to close the chamber, and the open position, in which the sleeve is spaced from the body portion to open the chamber.

Preferably, the noise generation device comprises a body seal member attached to, or mounted on, the body portion, and configured to seal with the sleeve when the sleeve is in the sealed position.

Preferably, the body seal member comprises a flange configured to be energised and seal against the inside of the sleeve as a result of an increase in pressure inside the chamber.

Preferably, the noise generation device comprises a sleeve seal member attached to, or mounted in, the sleeve, and configured to seal with the sleeve guide when the sleeve is in the sealed position, and between the open position and the sealed position.

Preferably, the sleeve seal member is configured to expand and contract while maintaining a seal. More preferably, the sleeve seal member comprises an annular member having a slit therethrough. Preferably the slit is oriented at an angle with respect to the edge of the annular member. Preferably the angle is 30 degrees.

In some embodiments, the annular member comprises a channel around the outside thereof, and the sleeve seal member comprises an O-ring positioned within the channel and configured to urge the slit of the annular member closed.

Preferably, the sleeve guide comprises a tapered outer surface configured to reduce the friction between the sleeve guide and the sleeve as the sleeve moves towards the open position.

Preferably, the sleeve guide comprises a first cylindrical portion around which the sleeve seal forms a seal in the sealed position, a second cylindrical portion over which the sleeve seal is able to slide when the sleeve seal is near the open position, and a tapered portion between the first cylindrical portion and the second cylindrical portion.

Preferably, the sleeve guide comprises a stopping flange for limiting movement of the sleeve away from the body portion. More preferably, the sleeve guide comprises an end cap, secured to the sleeve guide, providing the stopping flange to the sleeve guide.

Preferably, the spring is mounted on the sleeve guide between the stopping flange and the sleeve.

In some embodiments, one or more of the spacer elements which attach the sleeve guide to the body comprises a hollow cable pillar through which one or more cables and/or conduits are able to pass across the chamber.

In some embodiments, the noise generation device comprises a detector configured to detect that the sleeve is not in the sealed position. Preferably, the detector is located within the sleeve guide, and configured to detect when the sleeve is adjacent or proximate the detector. Preferably, the detector is positioned behind a hole in the sleeve guide, and is configured to detect that the sleeve is over the hole. For example, the detector may comprise an infrared sensor for detecting the presence of the sleeve over the hole.

In some embodiments, the sleeve comprises a first magnetic member and the sleeve guide comprises a second magnetic member, the first and second magnetic members positioned to bias the sleeve to the sealed position through a mutually attractive magnetic force.

In one embodiment, the first and second magnetic members comprise a magnet and steel ring, the steel ring located on or as part of the sleeve, the magnet located within the sleeve guide configured to attract the steel ring, and thereby the sleeve, to the sealed position.

In some embodiments, the sleeve comprises an inner surface with a contour configured to cause the sleeve to move along the sleeve guide away from the body portion when material combusts in the chamber. For example, the inner surface of the sleeve may comprise a shoulder facing the body portion of the noise generation device.

Preferably, the means for injecting combustible material into the chamber comprises:

- a conduit connected or connectable to a reservoir of combustible material; and
- a valve.

In a preferred embodiment of the invention, the valve is a solenoid valve.

Preferably, the noise generation device comprises a reservoir of combustible material. The combustible material may be in the form of a combustible gas, for example propane or butane.

In preferred embodiments, the noise generation device comprises a regulator for regulating the flow of gas injected into the chamber.

Preferably, the means for triggering combustion comprises means for generating a spark inside the chamber. More preferably, the means for generating a spark inside the chamber comprises spark probes extending into the chamber substantially in front of the valve.

The noise generation device may comprise means for sensing the temperature inside the chamber and means for disabling operation of the noise generation device if the chamber temperature exceeds a predetermined temperature limit. For example, the means for sensing the temperature may comprise a thermistor.

In some embodiments, the noise generation device comprises a pump operable to remove gas from the chamber. In some embodiments, the noise generation device is configured to operate the pump in the event of a failed attempt at ignition. In some embodiments, the pump applies a vacuum to draw gas out of the chamber. In other embodiments, the pump generates a flow of fresh air to displace gas from the chamber.

Preferably, the noise generation device comprises a controller. The controller may be adapted to control operation of the noise generation device. For example, the controller may be operable to control the means for injecting combustible material into the chamber and the means for triggering combustion of the combustible material.

In some embodiments of the invention, the controller is operable to trigger operation of the noise generation device in response to a received signal. The noise generation device may comprise a receiver to receive the signal, triggering the noise generating device to operate. More preferably, the noise generation device comprises means for detecting a voltage drop in a power supply and is operable to trigger operation of the device as a result of a voltage drop detection.

In some embodiments, the noise generation device comprises means for detecting a current, and is operable to trigger operation of the device as a result of detecting the current.

In some embodiments, the noise generation device comprises means for detecting an acceleration, and is operable to trigger operation of the device as a result of detecting the acceleration. Preferably, the means for detecting an acceleration of the device is an accelerometer configured to detect acceleration of a device to which the noise generation device is attached.

In some embodiments, the noise generation device comprises means for detecting a sound, and is operable to trigger operation of the device as a result of detecting the sound.

In some embodiments, the noise generation device is operable to trigger operation of the device as a result of detecting any one or more of a voltage drop, current, acceleration, and sound.

Preferably, the controller is operable to trigger combustion of the combustible material a predetermined period of time after combustible material has been injected into the chamber.

According to a second embodiment of the invention there is provided a gun attachment operable to simulate the noise of a gun, the gun attachment comprising:

a housing defining a sealed chamber;

means for injecting combustible material into the chamber;

means for triggering the combustible material to combust inside the chamber to generate a noise;

means for allowing exhaust material to exit the chamber after combustion; and means for attaching the gun attachment to a gun.

It will be understood that the gun attachment may be configured to connect to any type of gun, including guns intended for use in warfare, hunting or recreational combat sports such as paintball, airsoft and laser tag. The invention is not limited by the type of gun with which the gun attachment may be used and suitable mechanisms for attaching a gun attachment to an individual type or model of gun will be apparent to the skilled addressee.

Preferably, the means for triggering combustion comprises means for triggering operation of the gun attachment in response to a received signal. More preferably, the gun attachment comprises means for detecting a voltage drop in a power supply and is operable to trigger operation of the device as a result of a voltage drop detection.

In another embodiment of the invention, the gun attachment comprises means for detecting a current, and is operable to trigger operation of the gun attachment as a result of detecting the current.

In some embodiments, the gun attachment comprises means for detecting an acceleration, and is operable to trigger operation of the gun attachment as a result of detecting the acceleration. Preferably, the means for detecting an acceleration of the device is an accelerometer, and the detected acceleration that triggers operation of the gun attachment is of a nature expected of recoil caused by firing of the gun.

In some embodiments, the gun attachment comprises means for detecting a sound, and is operable to trigger operation of the gun attachment as a result of detecting the sound.

In some embodiments, the gun attachment is operable to trigger operation of the gun attachment as a result of detecting any one or more of a voltage drop, current, acceleration, and sound. In some embodiments the gun attachment comprises a receiver for receiving a signal corresponding to the voltage drop, current, acceleration, or sound, as the case may be.

Preferably, the gun attachment is configured to simulate the appearance of a gun part or accessory.

Preferably, the means for allowing exhaust material to exit the chamber after combustion comprises a moveable wall member of the housing, and means for causing the moveable wall member to move from a sealed position, in which the chamber is fluidly sealed, to an open position, in which the chamber is open, on combustion of the material inside the chamber to allow material to exit the chamber.

Preferably, the combustion of the material causes the moveable wall member to move from the sealed position to the open position. More preferably, combusting material pushes the moveable wall member to move from the sealed position to the open position. In some embodiments, the moveable wall member may comprise an internal surface against which combusting material is able to apply pressure to move the moveable wall member from the sealed to open position.

Preferably, the gun attachment comprises means for moving the moveable wall member back to the sealed position from the open position.

The means for moving the moveable wall member back to the sealed position from the open position may comprise a spring configured to compress when the moveable wall member is in the open position and to expand to push the moveable wall member into the sealed position.

According to a third embodiment of the invention, there is provided a simulation weapon, comprising:

a housing defining a sealed chamber;

an injection assembly for injecting combustible material into the chamber;

a triggering assembly for triggering the combustible material to combust inside the chamber to generate a noise;

wherein the simulation weapon is configured to allow exhaust material to exit the chamber after combustion.

In some embodiments the simulation weapon is in the shape of a gun and comprises a barrel portion, the chamber being located within the barrel portion of the simulation weapon.

In some embodiments the simulation weapon comprises a laser device configured for use in a laser training system, and the triggering assembly triggers the combustible material to combust when the laser device is operated, to produce a noise.

Preferably, the barrel portion defines a longitudinal axis of the simulation weapon and any one or more of: the spark module; the chamber; the valve; the regulator; the reservoir and the laser emitter are aligned along the longitudinal axis.

Further aspects of the invention, which should be considered in all its novel aspects, will become apparent to those skilled in the art upon reading of the following description which provides at least one example of a practical application of the invention.

BRIEF DESCRIPTION OF THE DRAWINGS

One or more embodiments of the invention will be described below by way of example only, and without intending to be limiting, with reference to the following drawings, in which:

FIGS. 8*a-b* are illustrations of a seal included in the noise generation device shown in FIGS. 5 and 6;

DETAILED DESCRIPTION OF PREFERRED EMBODIMENTS OF THE INVENTION

The invention generally relates to a device for generating noise, and in particular a device for simulating the noise of a gun, firearm or the like. The device may be used in isolation, it may be configured as an attachment to a gun, for example a paintball gun, airsoft gun or laser gun, or it may be integral to the gun.

A noise generation device according to one embodiment of the invention comprises a housing defining a chamber in which one or more of the chamber walls are moveable between one position in which the chamber is fluidly sealed and another position in which the chamber is open to the external atmosphere. Combustible material is injected into the sealed chamber and combustion of the combustible material is triggered. This generates an explosion which generates a gun-like noise. At the same time, the moveable wall of the chamber is opened to allow exhaust material to exit the chamber.

Following the combustion of material, fresh air flows into the open chamber. The moveable wall then moves back into place to re-seal the chamber ready for more combustible material to be injected for the next 'firing' of the device (i.e. noise generating process).

Exemplary Noise Generation Device

Figure 1:
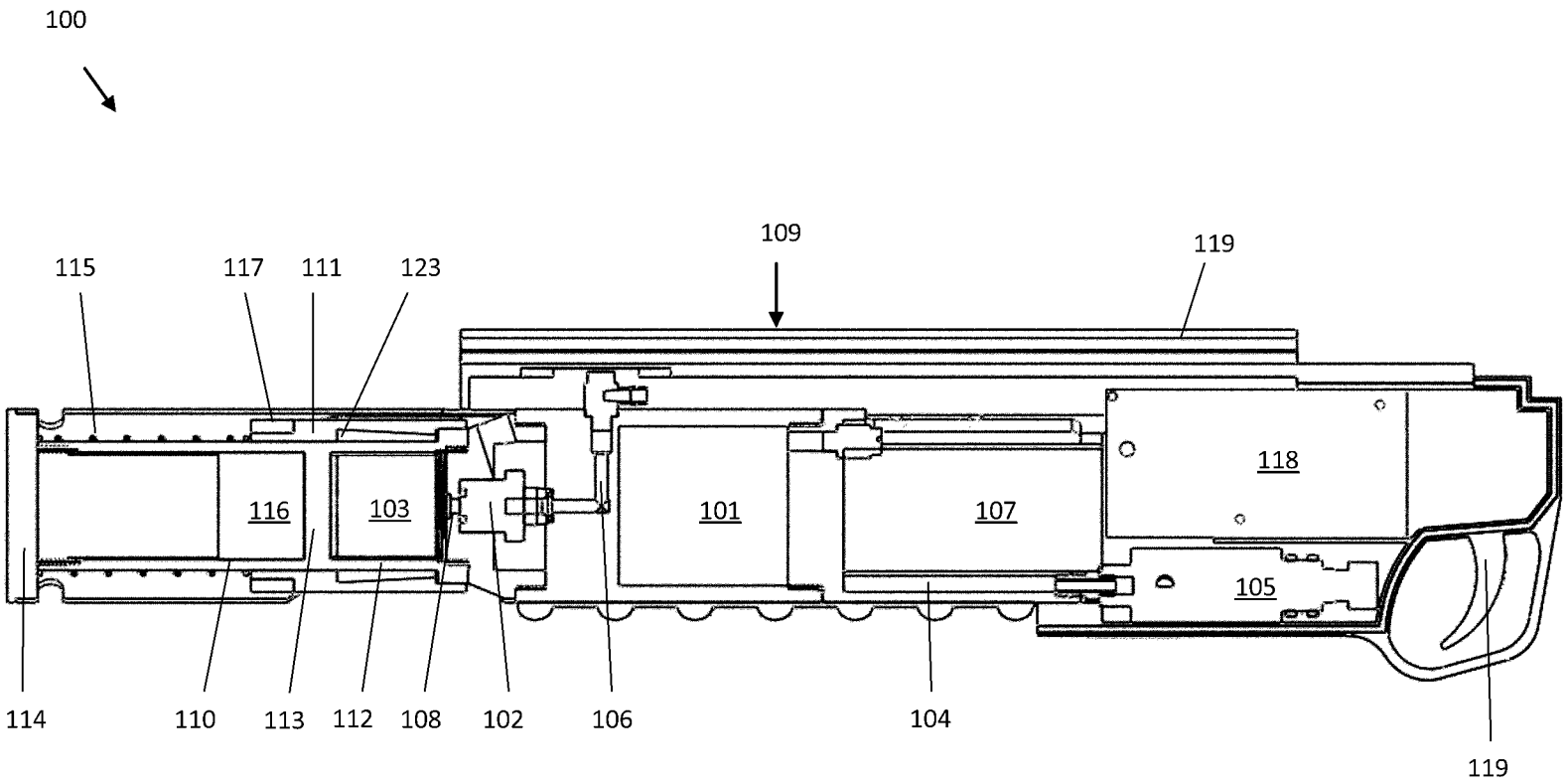
FIG. 1 is a cross-sectional view illustration of a noise generation device according to one embodiment of the invention.

FIG. 1 is a cross-sectional view illustration of a noise generation device 100 according to one embodiment of the invention. Noise generation device 100 is capable of being attached to a gun, as will be described further below, or any other device. It may also operate independently from a gun or any other device.

Combustible material is stored in reservoir 101. Any form of combustible material may be used, including combustible gases such as propane and butane or a mixture of such gases. The combustible gas may be stored under pressure in reservoir 101. In some embodiments of the invention, the gas is stored in the reservoir 101 at a pressure of 150-200 psi.

An outlet conduit of the reservoir 101 is connected to a valve 102, which is operable to inject the gas into a chamber 103. In the embodiment shown in FIG. 1, the reservoir 101 is connected to an outlet conduit 104, which is connected to a regulator 105 to control the pressure of gas to the valve 102, with which the regulator 105 is fluidly connected via conduit 106. In one embodiment of the invention, the regulator sets the gas pressure for injection into the chamber 103 at approximately 100 psi.

In the embodiment shown in FIG. 1, valve 102 takes the form of a solenoid valve. A solenoid valve may be advantageous since it can be controlled by electric currents. However other types of valves may be used in other embodiments.

In one embodiment, the noise generation device comprises a solenoid valve with a 0.3 mm orifice that is open for a period such as 12-20 ms. The duration that the solenoid valve is open needed to inject the amount of gas into the chamber to result in a desired explosion will vary depending on the size of the orifice, size of the chamber, the type of gas used and the temperature, as well as other conditions. For example, in another embodiment the solenoid valve used has a 0.6 mm orifice, which reduces the required duration that the valve is open, reducing the cycle time and allowing for an increased firing rate. The noise generation device may comprise a means for controlling the valve open duration so that a user can adjust the duration at any time. For example, a dial or other control interface may be provided.

Noise generation device 100 comprises means for triggering combustion of the combustible material in chamber 103. In the embodiment of FIG. 1, a spark module 107 is connected to spark probes 108, which extend outwards into chamber 103 generally in front of valve 102. The spark module 107 is operable to generate sparks across the spark probes 108. In one embodiment of the invention, the spark ignition voltage may be around 10 kV and the probes are positioned 5 mm in front of the valve and 2.5-3 mm apart, although the optimal spacing may vary depending on the particular spark module used, the voltage used, etc.

The above described components are housed in a body portion 109 of noise generation device 100.

Figure 5:
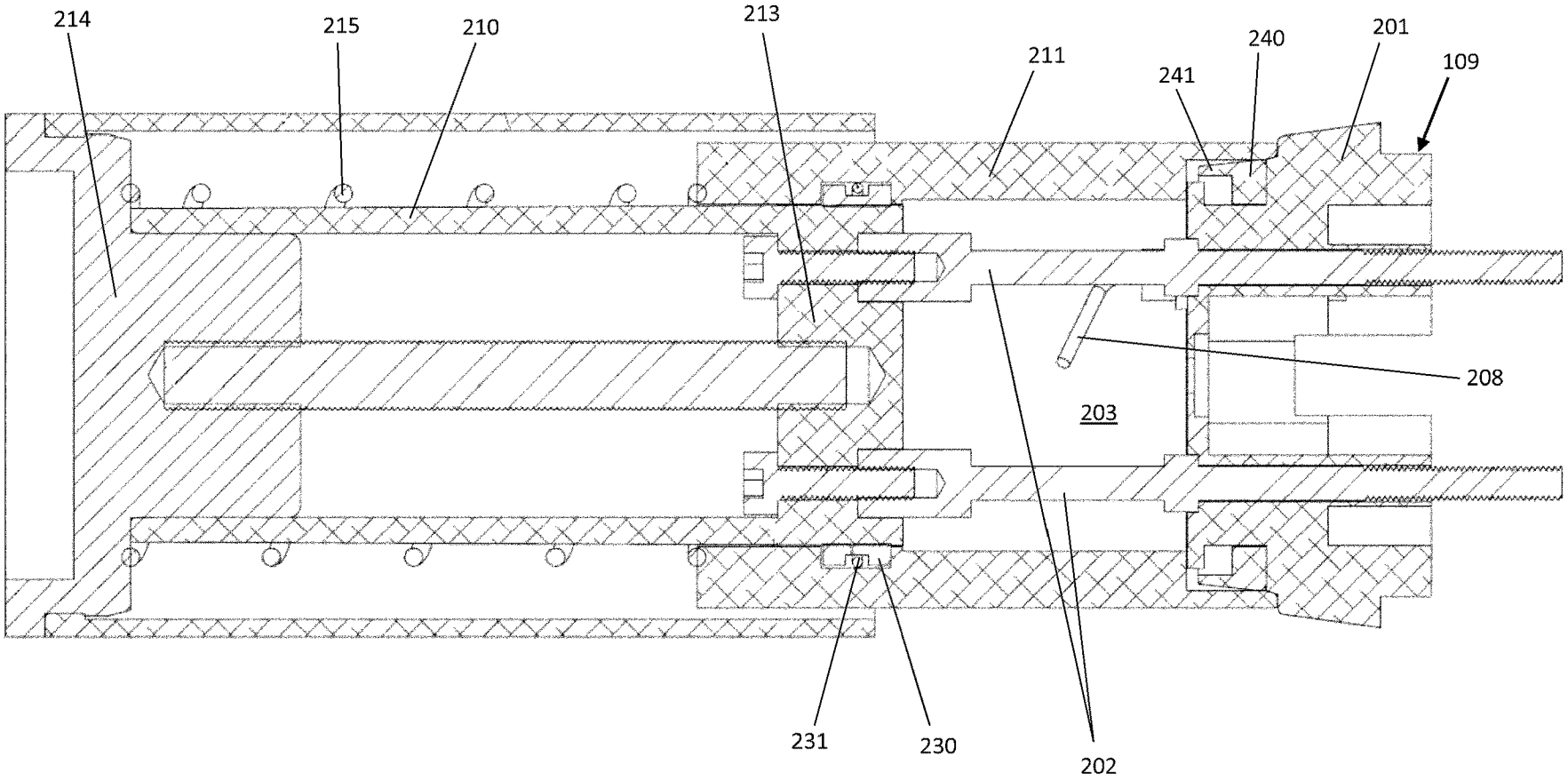
FIG. 5 is a cross-sectional view illustration of the forward portion of a noise generation device, in a closed configuration, according to another embodiment of the invention.
Figure 6:
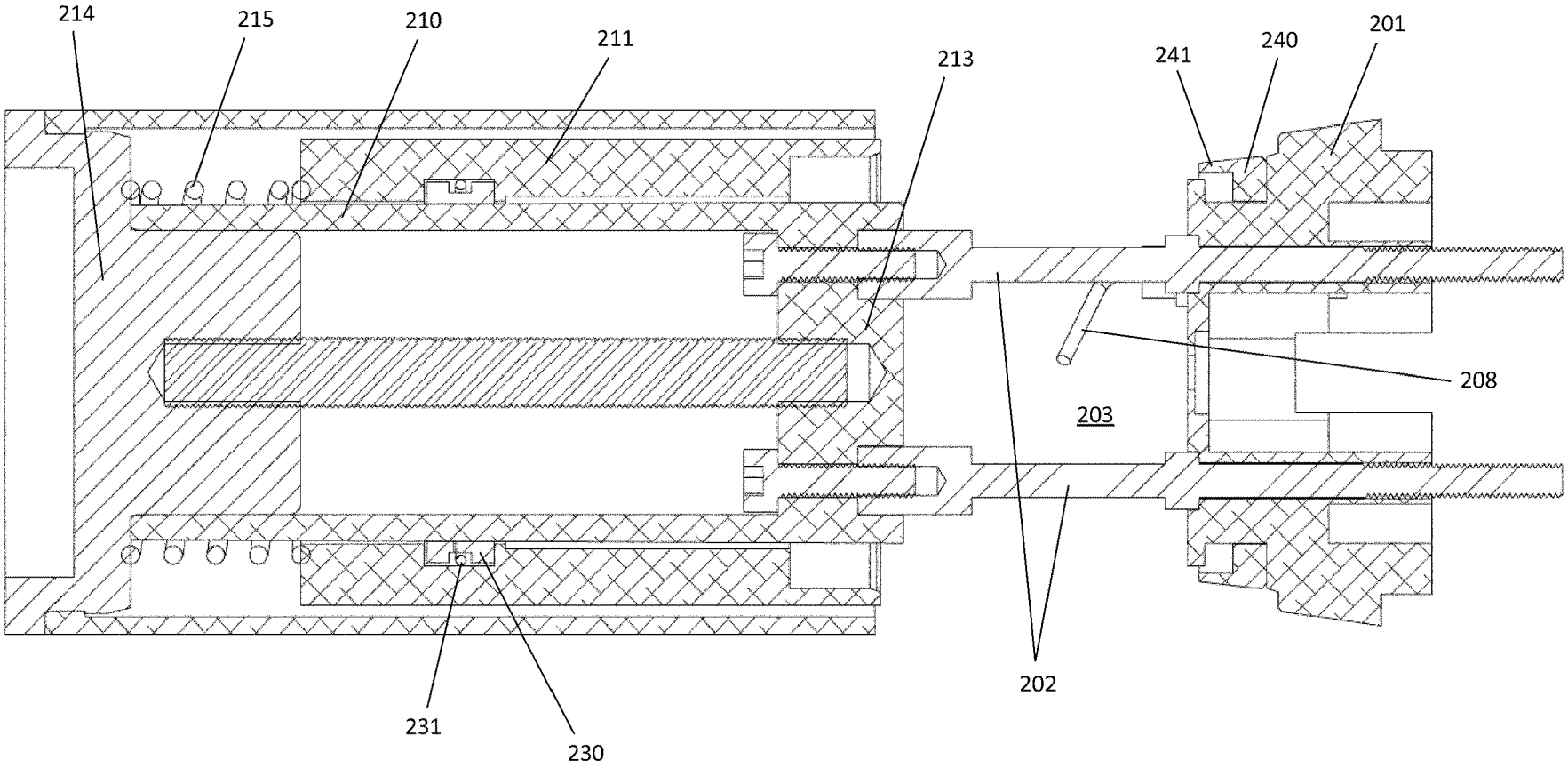
FIG. 6 is a cross-sectional view illustration of the forward portion of the noise generation device shown in FIG. 5, in an open configuration.

FIG. 5 is a cross-sectional view illustration of the forward portion 200 of a noise generation device, in a closed configuration, according to one embodiment of the invention. FIG. 5 shows a detailed view of further components which may be connected to the body portion 109 of FIG. 1 in one particular preferred embodiment of the noise generation device, in a closed configuration. FIG. 6 is a cross-sectional view illustration of the forward portion 200 of the noise generation device shown in FIG. 5, in an open configuration.

Figure 2:
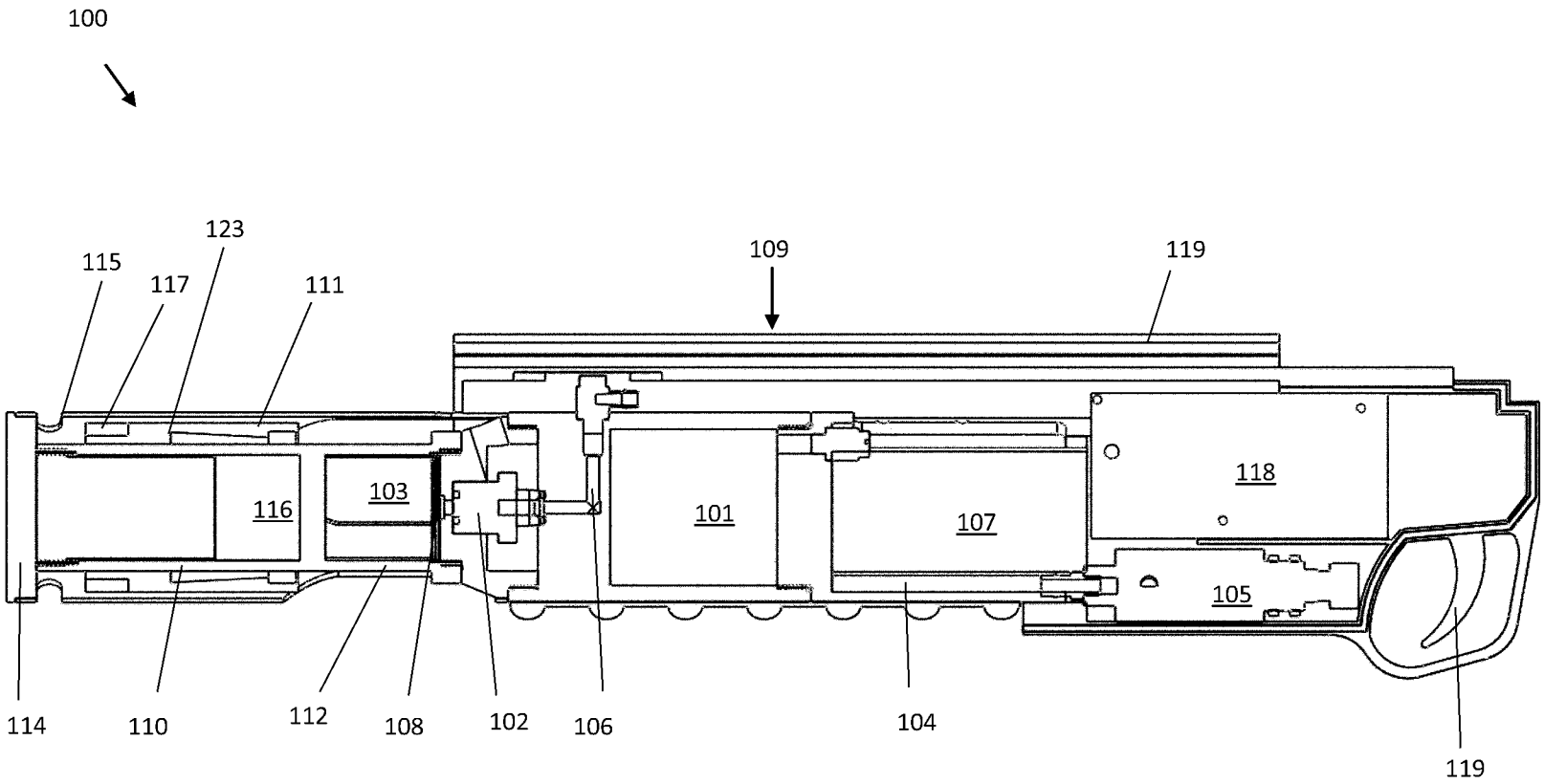
FIG. 2 is a cross-sectional view illustration of the noise generation device shown in FIG. 1 in a different configuration.

One preferred embodiment of the invention includes the body portion 109 and the components housed within, as shown in FIGS. 1 and 2, but includes the components attached forward of body portion 109 as shown and described with reference to FIGS. 5 and 6. The components shown attached forward of body portion 109 in FIGS. 1 and 2 may be included in an alternative embodiment of the invention.

With reference to FIGS. 5 and 6, in this embodiment a gas head 201 which houses the valve 102 mounted in or at the end of the body portion 109. FIGS. 7*a-e* show the gas head 201 in detail and will be described in more detail later.

Extending longitudinally from the body portion 109 is a sleeve guide 210 mounted to the gas head 201.

Sleeve guide 210 may take the form of a cylindrically shaped member. Mounted on the sleeve guide is a sleeve 211. The sleeve 211 is configured to slide longitudinally along the sleeve guide 210. In the preferred embodiment illustrated in FIG. 5, where the sleeve guide 210 is cylindrically shaped, sleeve 211 is generally annular. The sleeve guide 210 is tapered so that the forward end (in this embodiment the end away from the gas head 201) comprises a diameter slightly smaller than the rearward end—this advantageously allows for greater movement of the sleeve 211. Between the gas head 201 and the sleeve guide 210 is a combustion chamber 203 which is operated in substantially the same way as chamber 103 in the embodiment shown in FIG. 1.

In this embodiment, an end portion 213 of the sleeve guide 210 is connected to the gas head 201 with spacer rods 202. There are two spacer rods 202 with threaded ends that pass through holes in the gas head 201 to be received securely within the body 109 of the noise generation device. The holes in the gas head 201 through which the threaded ends of spacer rods 202 pass are countersunk to receive correspondingly sized sealing stops formed integrally as part of the spacer rods 202. The distal ends of the spacer rods 202 have holes tapped to receive screws, so that the end portion 213 of the sleeve guide 210 can be secured onto the forward ends of the spacer rods 202.

An electrode 208 is shown in FIGS. 5 and 6 within the chamber 203. A spark can be generated between this electrode 208 and another electrode (not shown) within the chamber 203. In this embodiment the electrodes are 5 mm in front of the gas head and 4 mm apart from each other.

Figure 7:
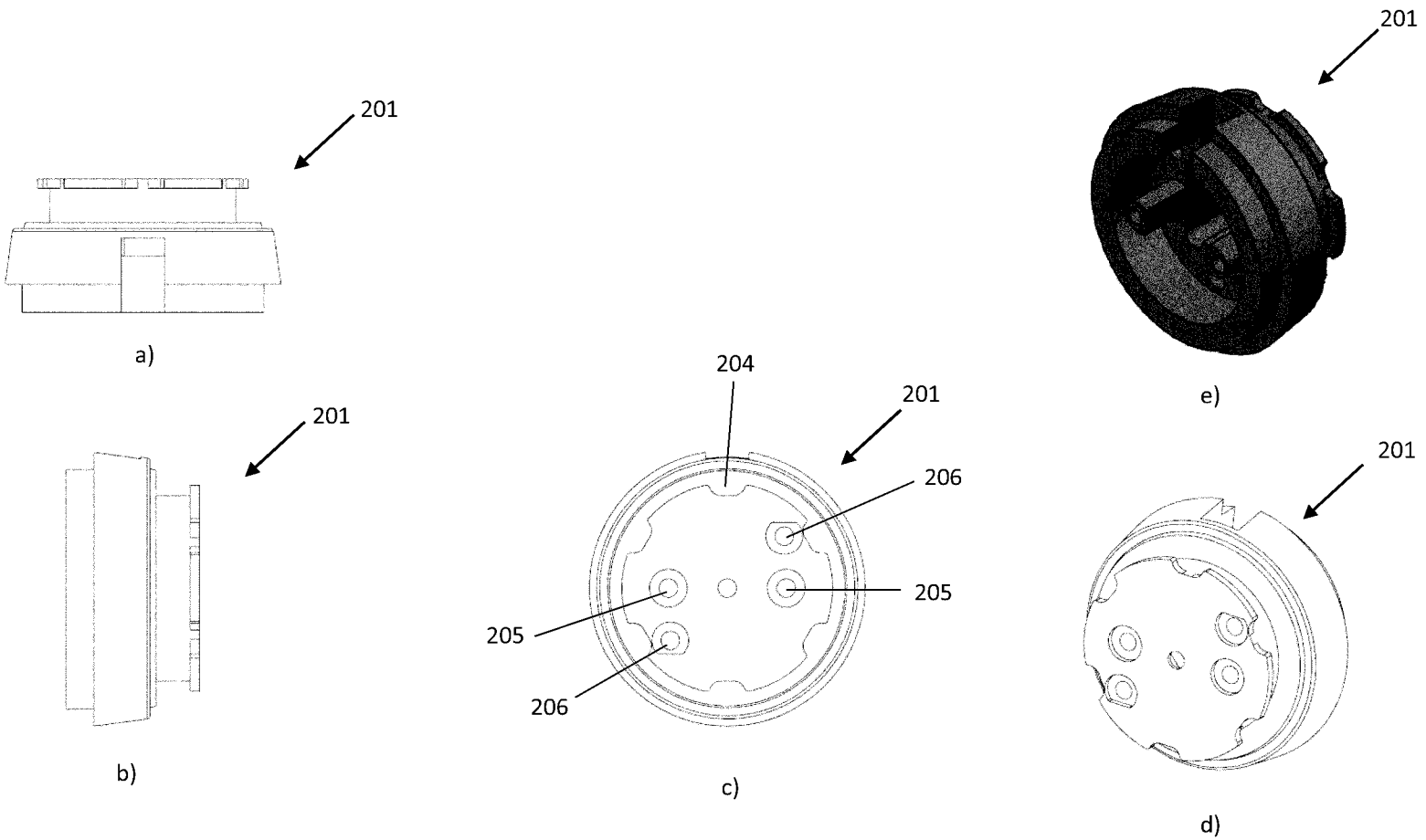
FIGS. 7*a-e* are illustrations of a gas head of the noise generation device shown in FIGS. 5 and 6.

FIG. 7, including views a)-e), show the gas head 201 in detail. At a front end the gas head 201 has an extending cylindrical portion with spacer rod holes 205 and electrode holes 206. Holes 205 receive the spacer rods 202, and are counterbored to receive the enlarged portion of the spacer rods. Holes 206 hold the electrodes 208 in the gas head 201, allowing the electrodes to pass into the chamber 203, with the wiring on the other side of the gas head 201. The forward extending cylindrical portion is flanged so that a seal (described later) can be retained on the cylindrical portion. The flange in this preferred embodiment comprises notches 204 which assist in allowing air from the surroundings to travel into the chamber 203 after firing.

In FIG. 5, showing sleeve 211 in the sealed position, sleeve 211 abuts body 109. In this position, sleeve 211, end wall portion 213 of sleeve guide 210 and the end of body 109 define the walls of a chamber 203, which is a chamber similar to chamber 103, of the embodiment shown in FIG. 1, in which combustible material is combusted to produce the noise generated by the noise generating device.

It is helpful for allowing the unit to fire if a seal about chamber 203 is created when the sleeve is in the sealed position (shown in FIG. 5), however it is also important that the sleeve is able to slide back and forth freely with low friction.

The gap between sleeve 211 and sleeve guide 210 in this embodiment is sealed by a sleeve seal 230, 231.

FIGS. 8*a* and 8*b* show the sleeve seal 230. The sleeve seal is in the form of a ring or annular member 230 with a central channel around the outer side of the ring, and a slit 232 through the ring 230 on an approximately 30 degree angle with respect to the edge of the sleeve seal. In this embodiment the internal diameter of the ring 230 is 0.1 mm less than the outer diameter of the sleeve guide 210. The slit 232 allows the ring 230 to expand and contract, and therefore assists the sleeve seal to seal on the surface of the sleeve guide 210. During firing, the ring 230 will expand due to heat. In this embodiment there is an O-ring 231 that fits within the channel on the outer surface of the ring 230 that prevents the ring 230 from excessive thermal expansion by urging the ring to radially contract and the slit to close, allowing the sleeve seal to keep a sufficiently tight seal around the sleeve guide 210. The O-ring 231 and slit 232 also advantageously allow for the ring 230 to seal quickly to the sleeve guide 210, allowing for rapid firing of the device, and also accommodate a degree of tolerance in manufacturing of the components of the noise generation device.

In this embodiment the ring 230 is formed from Teflon, although in other embodiments it could be formed from any PTFE or any other suitable material.

The noise generation device of the embodiment described with reference to FIG. 5 also includes a body or gas head seal 240 in the form of a ring which fits around the forward portion of the gas head to create a seal between the sleeve 211 and a part of the body of the noise generation device, for example the gas head 201. The outer diameter of the body seal 240 is equal to or slightly greater than the internal diameter of the sleeve 211, to allow for compression of the seal 240 when the sleeve 211 is in the sealed position (shown in FIG. 5), improving the seal created. In some embodiments, the seal may fit loosely around the gas head, while in other embodiments the seal may fit tightly around the gas head.

Figure 9:
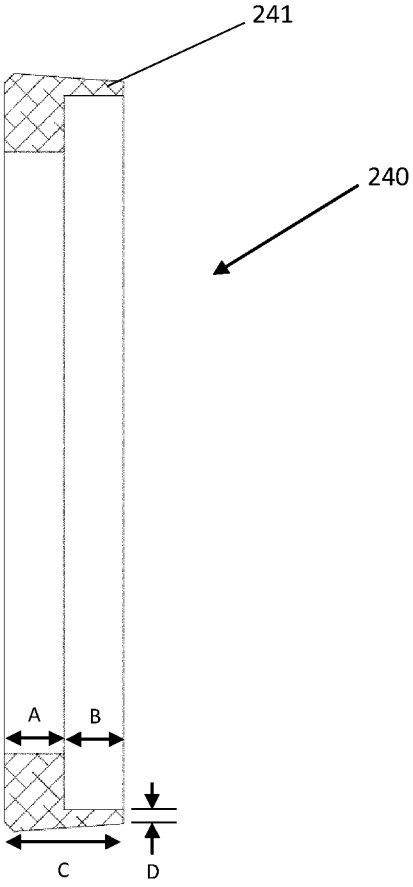
FIG. 9 is a cross-sectional view illustration of another seal included in the noise generation device shown in FIGS. 5 and 6.

The seal 240 includes an integrally formed annular flange 241 extending away from the body 109 towards the sleeve 211 from an outer edge of the body of seal 240. FIG. 9 is a cross-sectional view illustration of flange 241. The outer surface of flange 241 is angled inwards away from the body of seal 240 so that the sleeve 211 butts against the front edge of the flange 241 when moving to the sealed position from the open position after firing. The inward angle of the flange 241 may be any suitable angle, such as between approximately 5-10 degrees.

When the noise generation device is fired, the body seal 240 becomes energised by the increased pressure in chamber 203 and the flange 241 is forced against the sleeve 211, improving the seal as the pressure inside the chamber 203 increases, until the pressure becomes too high and the sleeve 211 is forced away from the gas head 201 to allow the exploded gas to escape chamber 203, producing the firing noise. When the sleeve 211 is forced off the seal 240 during firing, the characteristics of seal 240 can affect the noise produced by the noise generating device. In particular, a more flexible flange 241 can produce a sound having a higher pitch. For example, the thicker the flange, the lower the pitch. Furthermore, a longer flange 241 (i.e. extending further away from the body of seal 240) can produce a louder sound. However, if the flange 241 is too rigid, the device may fire less reliably.

Also labelled in FIG. 9 are dimensions A, B, C and D. In some embodiments, the dimension A is less than half the length of C. Dimension B controls the seal's ability to expand under pressure—if dimension B is too small, the flange 241 may be too rigid to seal properly, and the sound volume may be reduced. Dimension D affects the pitch of the noise generated.

The seal 240 is formed from polyurethane, however in alternative embodiments, any suitable rubber or other material suitable for providing the advantages described herein may be used.

In some alternative embodiments, the annular flange of the body seal may be split into two or more "tongue" like flanges, so that the flanges do not cover the complete circumference of the seal. The number of flanges and the proportion of the circumference of the flange they occupy can also alter the characteristic of the sound produced by the noise generation device, in a manner that can be readily determined by experiment.

In FIG. 6, the sleeve 211 is shown in the open position. In the open position, the chamber 203 is open to the surroundings because of the spacing between the end wall 213 of the sleeve guide and the forward end of the gas head 201. Combusting material can escape chamber 203 through the spaces between the spacer rods 202.

Mounted to the forward end of the sleeve guide 210 is an end cap 214. The end cap 214 has a central boss that is received inside the sleeve guide 210, which is hollow at the forward end to receive the end cap. A threaded rod connects the rear end of the sleeve guide 210 and the end cap 214. The forward end of the end cap 214 is radially larger than the rear end with the boss, providing a surface towards which the sleeve 211 moves.

The noise generation device comprises a means to move the sleeve 211 back to the closed, sealed position (shown in FIG. 5) from the open position (FIG. 6). In the preferred embodiment of FIGS. 5 and 6, a return mechanism in the form of a spring 215 is mounted on the sleeve guide 210 between the wide forward end of the end cap 214 and the sleeve 211. The wide forward end of the end cap 214 therefore acts as a stopping flange. When the sleeve 211 is in the open position the spring is compressed and exerts a force on the sleeve 211, biasing it back towards the sealed position. The spring 215 may also exert a force on sleeve 211 towards body 109 when the sleeve is in the sealed position to help maintain the seal between the sleeve 211 and the body 109.

The noise generation device may comprise means for reducing the friction between the sleeve 211 and the sleeve guide 210 so that the sleeve can slide easily between the open and sealed positions. Any way of reducing friction while maintaining the sealed contact between the sleeve 211 and the sleeve guide 210 may be used. For example, the external surface of the sleeve guide 210 may be chrome-plated. A lubricant may also be used.

Further Exemplary Embodiment of a Noise Generation Device

As described above, one embodiment of the invention includes:

- the features of the noise generation device 100 rear of the gas head—e.g. the body portion 109; and
- the features of the embodiment shown in FIGS. 5 and 6 connected to the front of body portion 109.

Figure 10:
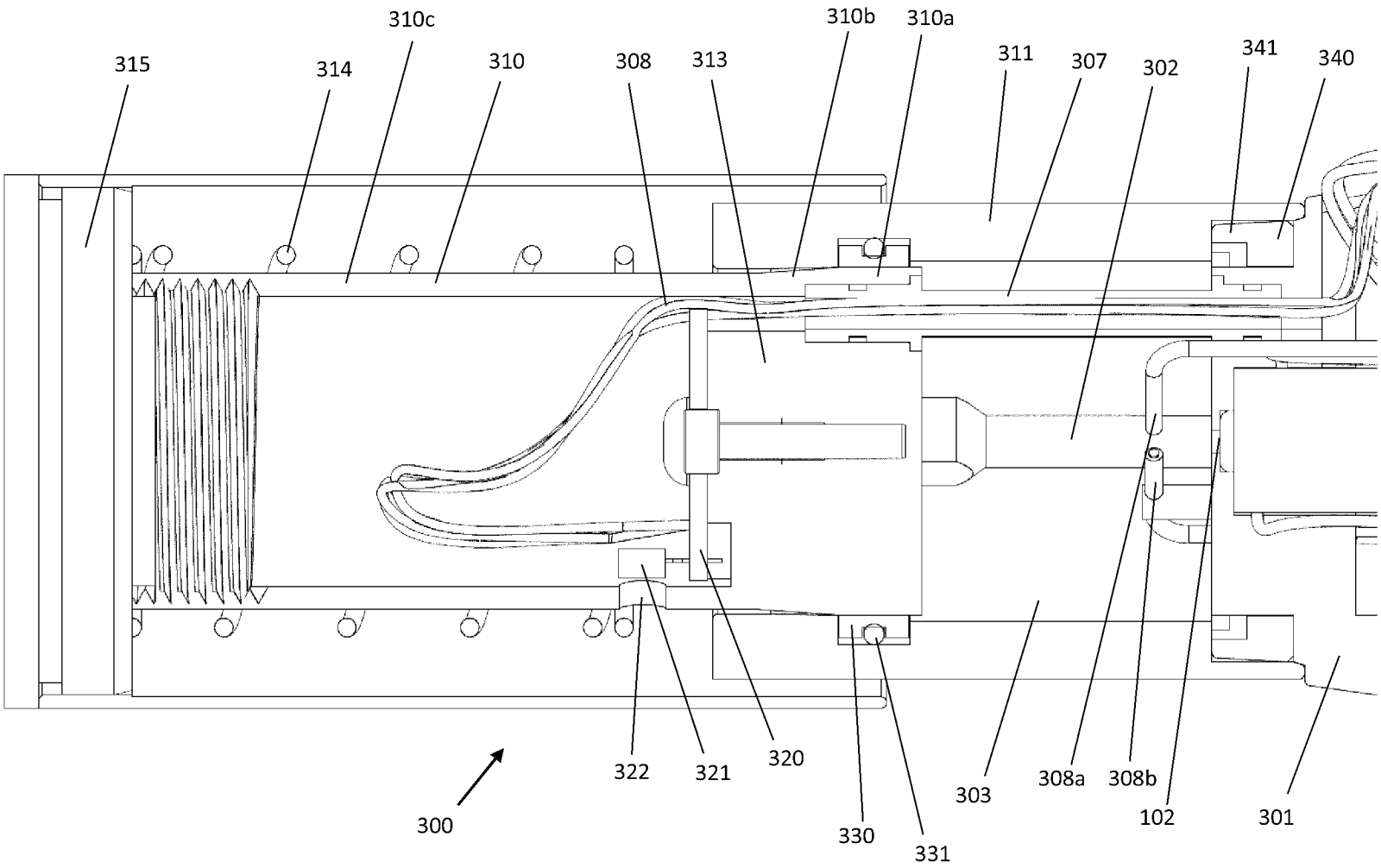
FIG. 10 is a cross-sectional view illustration of the forward portion of a noise generation device according to another embodiment of the invention.

An alternative embodiment of the invention includes:

- the features of the noise generation device 100 rear of the gas head—e.g. the body portion 109; and
- the features of a further embodiment of the invention, shown in FIG. 10, connected to the front of body portion 109.

FIG. 10 shows the forward portion 300 of a noise generation device according to a preferred embodiment of the invention, in a closed configuration. Many features of the preferred embodiment, and corresponding functions, are also present in the embodiment shown in FIGS. 5 and 6, and therefore the following description focuses on the differences in the preferred embodiment.

With reference to FIG. 10, a gas head 301 is attached to the body portion 109, which houses the valve 102. The gas head 301 supports a sleeve guide 310 spaced apart from the gas head 301. Similarly to sleeve guide 210, the sleeve guide 310 supports a sleeve 311 configured to partly define a chamber 303 between the sleeve guide 310 and the gas head 301. The sleeve 311 is configured to move on the sleeve guide 310 between and open and sealed position. The chamber 303 can be filled with combustible gas via the valve 102, which can be ignited by electrodes 308*a* and 308*b* to generate the noise of a gunshot. The sleeve 311 moves between a sealed position (as shown in FIG. 10), and an open position (similar to the open position of the sleeve 211 shown in FIG. 5). The forward portion 300 comprises a sleeve seal 330 and a body seal 340, which are substantially the same as the sleeve seal 230 and the body seal 240, respectively. Sleeve seal 330 in this embodiment is fitted with an O-ring 331 to assist the sleeve seal 330 to achieve a tight fit around the end portion 313 of the sleeve guide 330 in a similar manner to O-ring 231. Body seal 341 comprises a flange to provide substantially the same functions as flange 241 of the body seal 240. The sleeve 311 is biased towards the sealed position by a spring 314, which acts between an end cap 315 and the sleeve 311. In this embodiment, the end cap 315 comprises a threaded boss which is screwed into an internally threaded portion of the sleeve guide 310.

In this embodiment, the sleeve guide 310 is supported by way of support pillars 302 (only one of which is shown), and a cable pillar 307. The cable pillar 307 is hollow, and open at the ends, to enable cables to pass through its centre. The cable pillar 307 enables cables to pass from one side of the chamber 303 to the other without being exposed to combustion of gas.

In this embodiment, cables 308 are connected to electronic components in the body 109, and pass through the cable pillar 307 to provide power to PCB 320 within the sleeve guide 310 and mounted to an end portion 313 of the sleeve guide 310. Electrically connected to the PCB 320 is an infrared (IR) diode 321. Diode 321 is positioned behind an aperture 322 in the firing sleeve. The diode 321 is configured to emit and detect IR signals, and configured to detect whether the sleeve 311 is covering the aperture 322 by reflecting signals off the sleeve 311. If the diode 321 detects that the sleeve 311 is over the aperture, and therefore not in the sealed position, then a controller 118 in the body 109 may control operation of the device accordingly, for example by preventing a further ignition or supply of gas until the diode 321 detects that the sleeve 311 is no longer covering the aperture, and has therefore returned to the sealed position.

One useful feature of the embodiment shown in FIG. 10 is that the sleeve guide 310 comprises an improved tapered outer surface in comparison to the tapered outer surface of the sleeve guide 210. The sleeve guide 210 is tapered gradually and constantly along its length. The sleeve guide 310 comprises a first cylindrical portion 310*a* proximate the chamber 203, a second cylindrical portion 310*c* distal from the chamber 302, and a tapered portion 310*b* connecting the first cylindrical portion 310*a* and the second cylindrical portion 310*b*. The first cylindrical portion 310*a* has a greater diameter than the second cylindrical portion 310*c*. When the sleeve 311 is in the sealed position, the sleeve seal 330 is seated on the first cylindrical portion 310*c*, which has a diameter large enough for the seal 330 to achieve a sufficiently tight seal. When the noise generation device is operated, and the sleeve 311 moves back towards the open position, the seal 330 passes over the tapered portion 310*b*. The reduction in diameter of the tapered portion 310*b* reduces the friction between the seal 330 and the sleeve guide 310, given the seal no longer fits as tightly. Finally, the second cylindrical portion 310*c* comprises an even smaller diameter, which allows the seal to run over the sleeve guide to the open position without significant friction. The three sections 310*a, b* and *c*, enable the sleeve seal 330 to form an effective seal in the sealed position, but enable low friction movement away from the sealed position. This increases the efficiency of the noise generation device and the wear on the seal 330, improving longevity.

Standalone Noise Generation Device

Figure 11:
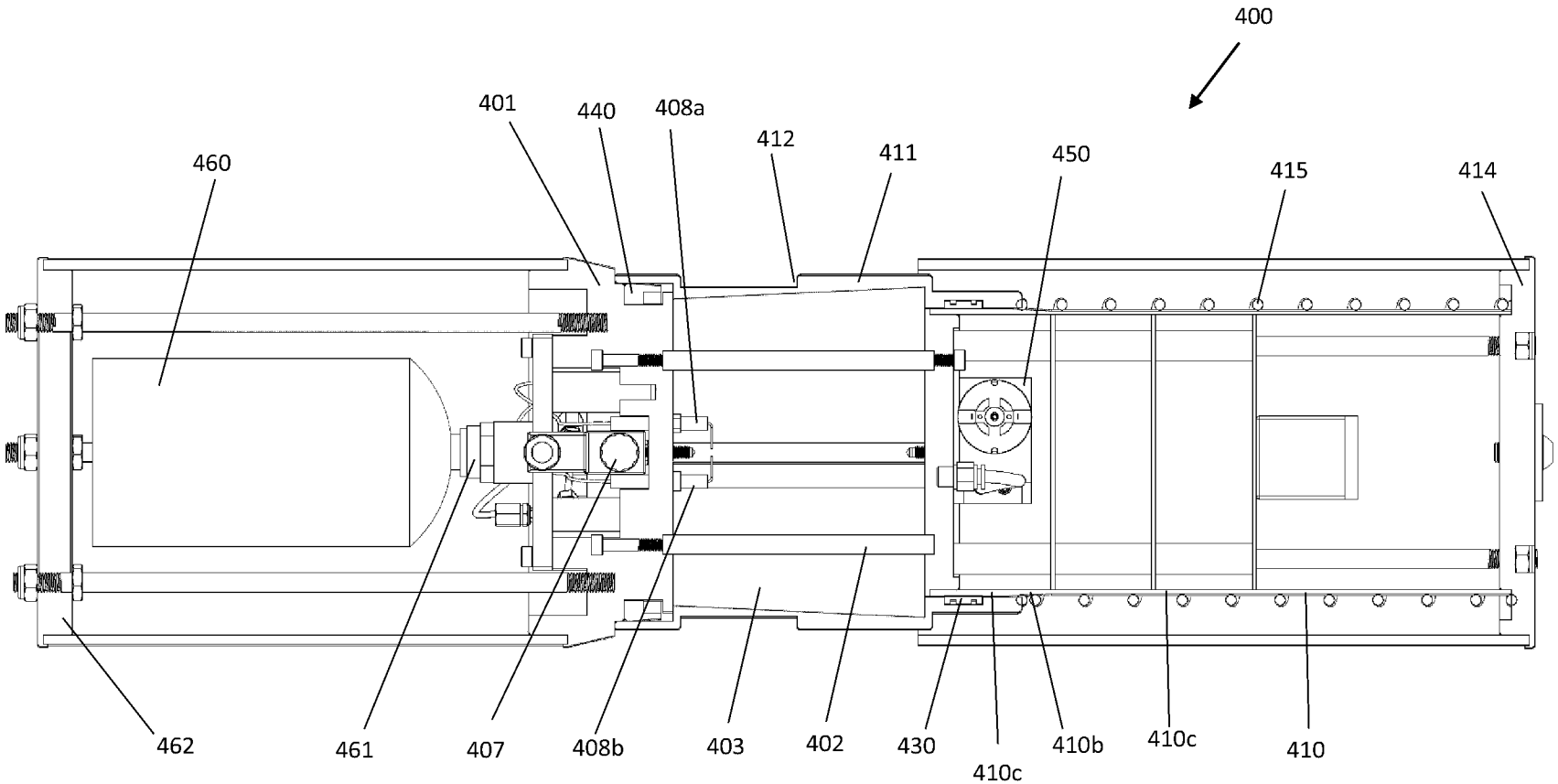
FIG. 11 is a cross-sectional view illustration of a noise generation device according to another embodiment of the invention.

FIG. 11 shows a standalone noise generation device 400 in accordance with another preferred embodiment of the invention. The noise generation device 400 may be several times larger, for example up to approximately six times larger, than the embodiment shown in FIG. 1, FIGS. 5 and 6, or FIG. 10, and may be particularly suitable for applications in which a louder noise is required but the device does need to be carried on a person or their simulation weapon. The noise generation device 400 may be useful for simulating an IED, clay-more, mine, other bomb, and the like. Additionally, the noise generation device 400 may be useful for implementation in a show (e.g. to replicate pyrotechnics), and/or as a bird scarer for use at an airport.

The noise generation device 400 operates similarly to the noise generation devices 200 and 300 described above. A combustion chamber 403 is defined by a gas head 401, a sleeve 411 and an end portion of a sleeve guide 410. Gas is injected into the chamber 403 via a valve 407 and ignited with electrodes 408*a* and 408*b*. The sleeve 411 slides from a sealed position (shown in FIG. 11) to an open position, and is biased towards the sealed position by a spring 415 which acts between the sleeve 411 and an end cap 414 which is connected to the sleeve guide 410. The sleeve guide 410 is mounted to, and spaced from, the gas head 401 by spacer rods 402. The sleeve 411 seals to the gas head 401 via a body seal 440, and seals to the sleeve 410 via a sleeve seal 430. The sleeve guide 410 comprises a first cylindrical portion 410*a*, a tapered portion 410*b*, and a second cylindrical portion 410*c*. These features are all similar to the corresponding features of the noise generation device disclosed in FIG. 10, unless described otherwise below.

Whereas in the previously described embodiments the noise generation device comprises a reservoir which is filled with gas, the noise generation device 400 comprises a gas adapter 461 configured to receive a gas bottle 460. It will be understood that the gas adapter can be manufactured or chosen to match the desired type of gas bottle. A base plate 462 can be removed to access and change the gas bottle 460. Providing a gas bottle within the device eliminates the need to fill a reservoir with gas, and may simplify the design of the device 400, given the gas bottle 460 provides a structure for retaining the pressurised gas which would otherwise need to be designed into the device 400.

The sleeve 411 comprises a step 412 which reduces weight by reducing the thickness of the sleeve 412. Additionally, the step 412 enables the device 400 to be cocked manually if necessary, for example to clear the chamber 403 or to inspect the inside of the chamber. The sleeve seal 430 is not provided with an O-ring like the embodiments of FIGS. 5 and 6, or FIG. 10. An O-ring on the sleeve seal may not be necessary (or may be less useful) once the device reaches a certain size. As the chamber 403 is large, the fraction of the gas that can escape past the seal 430 is small in comparison to the total amount of gas in the chamber 403. Therefore, using an O-ring as well as the sleeve seal 430 to seal the chamber 403 may provide an insignificant advantage. It should be understood, however, that in some embodiments an O-ring may be provided to the sleeve seal no matter how large the device. In some embodiments of large noise generation devices, an O-ring may be useful, for example if a lower quality seal is used, or the manufacturing tolerances are greater.

The noise generation device 400 also comprises a pump 450 fluidly connected to the chamber 403 and configured to pump exhaust gas out of the chamber 403. In this embodiment, the noise generation device 400 comprises a detector that determines whether or not combustion has occurred. In some cases, such as if moisture has accumulated in the chamber 403, or if the fuel-air mixture is not permitting for combustion. If this occurs and is detected by the device, then the pump 450 can be operated to pump out the contents of the chamber 403, allowing the chamber to be re-filled. The noise generation device 400 also comprises a battery 451 and PCBs 452 within the sleeve guide 410 to power and control the pump and the noise generation device. In alternative embodiments the pump and/or electronics and battery may be provided in a separate unit electrically connected to the noise generation device.

Simulation Weapon

Figure 12A:
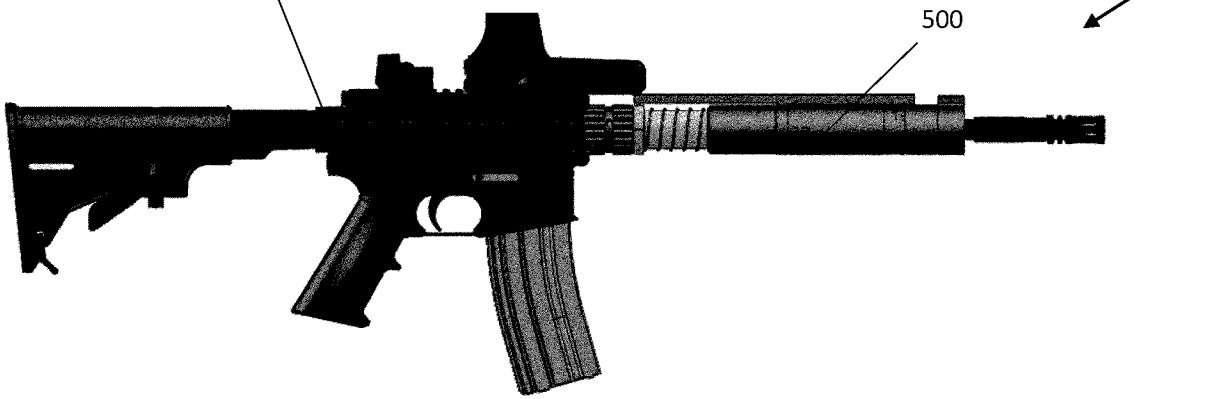
FIG. 12*a* is a side view illustration of a simulation weapon, according to an embodiment of the invention, with rail system not shown.
Figure 12B:
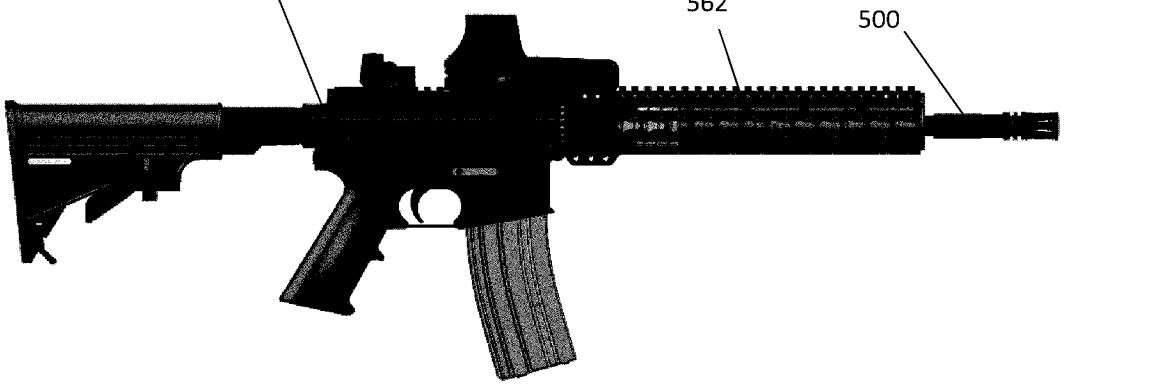
FIG. 12*b* is a side view illustration of the simulation weapon of FIG. 12*a*, with the rail system shown.
Figure 13:
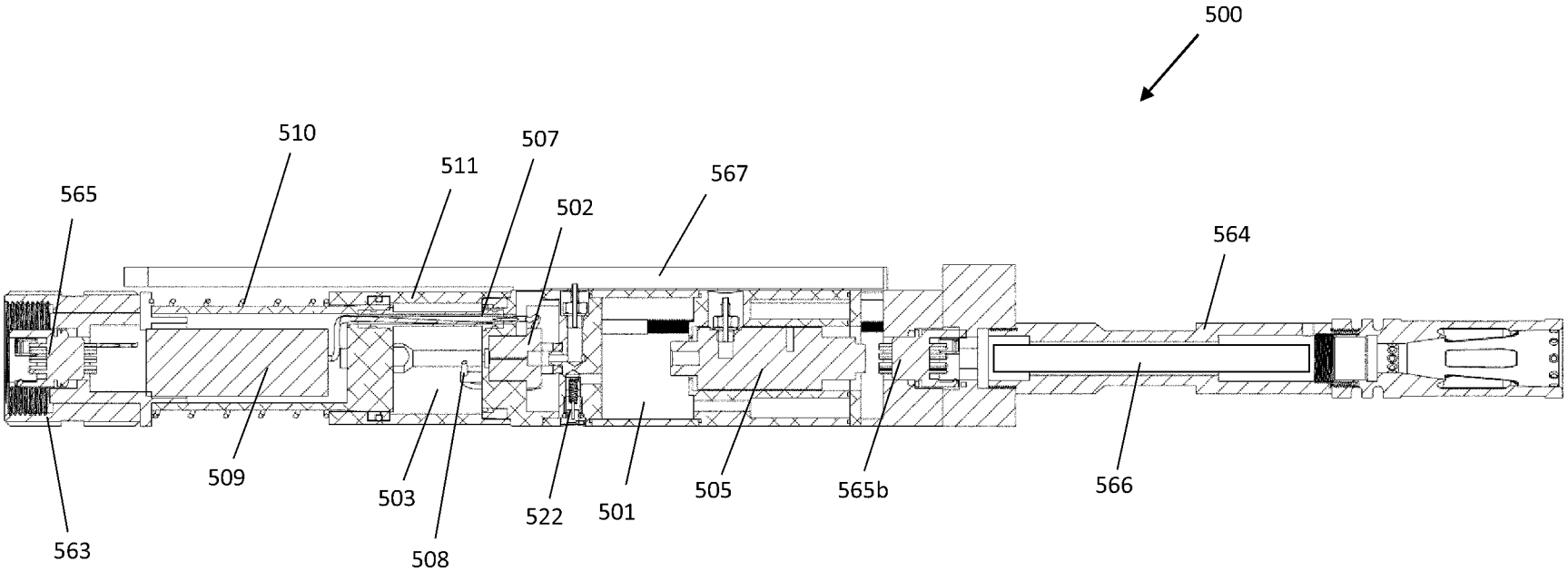
FIG. 13 is a cross-sectional view illustration of the barrel portion of the simulation weapon of FIG. 12*a;*

FIGS. 12*a* and 12*b* show side views of a simulation weapon 560, and FIG. 13 shows a cross section side view of a barrel portion 500 of a simulation weapon 560. The barrel portion 500 is configured to connect to the stock 561 of the simulation weapon 560. FIG. 13*a* shows the simulation weapon 560 without a rail system, whereas FIG. 13*b* shows the simulation weapon 560 assembled with a rail system 562 covering the barrel portion 500. The barrel portion 500 defines a longitudinal axis aligned with the barrel of the simulation weapon.

The barrel portion 500 comprises a noise generation device which operates in a similar manner to the noise generation devices 200 and 300, although the components are sized and arranged so that they fit within the forward portion (which may be known as a forend) of a simulation weapon. This reduces the size of the simulation weapon and may increase realism. In this embodiment the simulation weapon 500 is configured for use in a laser training system.

With reference to FIG. 13, the barrel portion 500 comprises a mounting portion 563 for mounting the barrel portion 500 onto the stock of the simulation weapon 560. At the end opposite the mounting portion 563 is a barrel end 564 shaped to have the appearance of the end of a real gun barrel. A laser device 566 configured for use in a laser training system is provided within the barrel portion 500 forwards of the noise generating components, configured to emit a laser beam out of the barrel end 564.

The way in which the barrel portion 500 of the simulation weapon 560 generates a noise is similar to the way in which the noise generating devices 200, 300 and 400 generate a noise, however there are differences in the arrangement of the components in the barrel portion 500. Firstly, a chamber 503 is located forward of the sleeve guide 510, and a reservoir 501 and valve 502 are located forward of the chamber. Gas flows forward from the reservoir 501 through a regulator 505, then back towards the valve 502, after which it is injected into the chamber 503. A sleeve 511 slides rearwards after ignition to vent the exhaust gas. A spark module 509 is located within the sleeve guide 510, and cables pass across the chamber from the spark module 509 through a cable pillar 507, to connect to electrodes 508 (only one of which is shown). It is advantageous in this embodiment to position the chamber 503 towards the rear of the barrel portion 500, so that a user can grip the barrel portion 500 towards the forward end of the barrel portion 500.

An electrical connector 565*a* provides power and control signals to the noise generating components within the barrel portion 500. A conduit is provided along the top of the barrel portion 500, through which cables (not shown) pass through to the laser device 566 at the barrel end 564, connecting via an electrical connector 565*b*. The noise generating components are preferably linked to the laser device, such that operation of the laser triggers operation of the noise generating components, to produce a noise, preferably sounding like a gunshot, simultaneously with the operation of the laser device. For example, operation of the laser device may cause the spark module 509 to trigger combustion of the gas within the chamber.

Alternative Embodiments

As has already been discussed, the preferred embodiment includes:

- the features of the noise generation device 100 rear of the gas head—i.e. the body portion 109; and
- the features of the embodiment shown in FIG. 10 connected to the front of body portion 109.

However, the embodiment shown in FIGS. 1 and 2 can be considered as a whole to be an alternative embodiment, due to different features forward of the body portion 109. This alternative embodiment is described below.

In the alternative embodiment, connected to the front of body 109, and extending longitudinally from the body, is a sleeve guide 110. Sleeve guide 110 may take the form of a longitudinal member of constant cross-section, for example a cylindrically shaped member. Mounted on the sleeve guide is a sleeve 111. The sleeve 111 is configured to slide longitudinally along sleeve guide 110. In the alternative embodiment of FIG. 1, where the sleeve guide 110 is cylindrically shaped, sleeve 111 is generally annular.

Sleeve guide 110 has a end wall portion 113 facing towards body 109 and is connected to the front of body 109 by one or more spacer elements 112. In the alternative embodiment of FIG. 1, spacer elements 112 are integral extensions of sleeve guide 110 that connect to body 109. Spacer elements 112 have spaces between them. In a further alternative embodiment, the noise generation device may comprise a single spacer element in the form of a single spine spanning the gap between the end wall portion 113 of sleeve guide 110 and body 109.

In FIG. 1, sleeve 111 is mounted on sleeve guide 110 such that it abuts body 109. In this position, sleeve 111, end wall portion 113 of sleeve guide 110 and the end of body 109 define the walls of a housing for chamber 103. The gaps between sleeve 111 and sleeve guide 110, and between the ends of sleeve 111 and body 109 are sealed by suitable sealing means (e.g. O-rings or rubber flanges) so that, in the position shown in FIG. 1, the chamber 103 is fluidly sealed.

The inside surface of sleeve 111 is shaped or contoured such that, when an explosion occurs inside chamber 103 and combusted material is expelled outward against the internal surface of the sleeve, the sleeve 111 is forced to move away from the body portion. Any suitable shaping of the inside surface of sleeve 111 may be used, and in the embodiment of FIG. 1, the internal surface comprises a shoulder 123 facing towards body portion 109, thereby presenting a surface to receive expelled material.

FIG. 2 is a cross-sectional view illustration of the noise generation device 100 shown in FIG. 1 with the sleeve 111 in a different position. Sleeve 111 is able to slide longitudinally along sleeve guide 110 between the positions shown in FIG. 1 and FIG. 2. In FIG. 2, chamber 103 is open to the external atmosphere because of the spaces between spacer elements 112. As such, the position of sleeve 111 in FIG. 2 is referred to herein as the 'open' position.

At one end of the sleeve guide 110 is a stopping flange 114 that limits the extent of movement of the sleeve 111 along the sleeve guide 110 away from the body 109.

The noise generation device comprises means to move the sleeve 111 back to the sealed position (of FIG. 1) from the open position (of FIG. 2). In the embodiment shown in FIGS. 1 and 2, a spring 115 is mounted on the sleeve guide 110 between the stopping flange 114 and sleeve 111. When the sleeve 111 is in the open position the spring is compressed and exerts a force on the sleeve 111, biasing it back towards the sealed position. The spring 115 may also exert a force on sleeve 111 towards body 109 when the sleeve is in the sealed position to help maintain the seal between the sleeve 111 and the body 109.

The noise generation device may comprise means for reducing the friction between the sleeve 111 and the sleeve guide 110 so that the sleeve can slide easily between the open and sealed positions. Any way of reducing friction while maintaining the sealed contact between the sleeve 111 and the sleeve guide 110 may be used. For example, the external surface of the sleeve guide 110 may be chrome-plated.

The noise generation device may comprise a return mechanism in form of one or more magnets to bias the sleeve 111 into the sealed position. The use of magnets in this way helps to maintain the sleeve 111 in the sealed position before the device is 'fired', for example if the device is pointed with the sleeve guide 110 downwards, gravity would tend to cause sleeve 111 to move into the open position and this may not be desired. If sleeve 111 is held in place by one or more magnets) whose force of attraction is sufficiently strong to counteract the force of gravity, the sleeve 111 will stay in place despite the orientation of the device. Secondly, the attractive force of the magnets may help to pull the sleeve 111 back into the sealed position having opened, as will be described in more detail below.

In the alternative embodiment of FIG. 1, a magnet 116 is embedded in the sleeve guide 110. The magnet 116 is attracted to another magnet 117 mounted on the sleeve 111. The attraction between the magnets 116 and 117 tends to move sleeve 111 into the sealed position shown in FIG. 1.

It will be appreciated that other embodiments of the invention may magnetically bias a moveable wall of the chamber into a sealed position in a different way. For example, magnets may be positioned in a different location. In one embodiment, for example, one of the magnets may be mounted on the body portion of the noise generation device. Alternatively, other sets of magnetic members may be used—for example a pairing of a magnet and a magnetic material that is not in itself magnetised but is attracted to a magnet.

Figure 14:
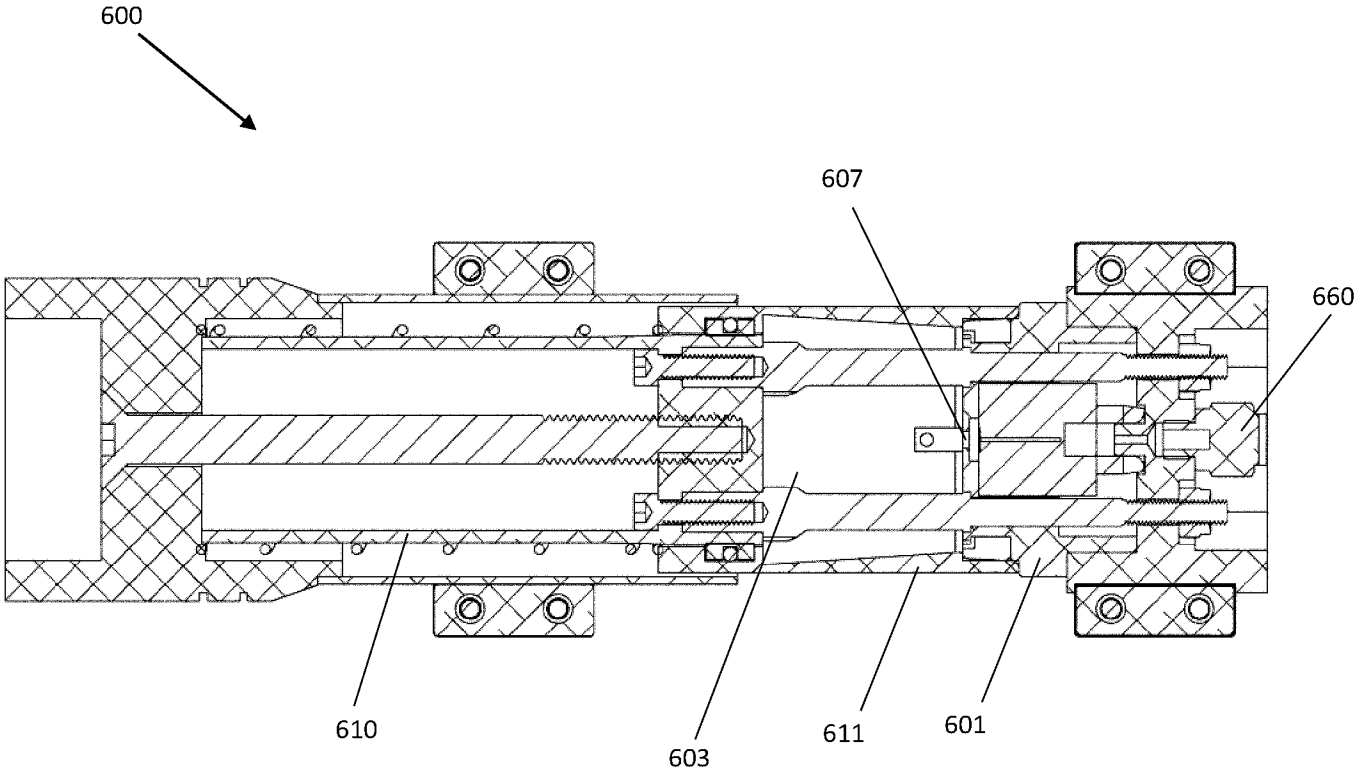
FIG. 14 is a cross-section view illustration of a noise generation device according to another embodiment of the invention.

FIG. 14 shows a cross section view of a noise generation device 600 according to another embodiment of the invention. The noise generation device 600 operates in a similar manner to the noise generation device 300, and comprises a gas head 501, a combustion chamber 603, as sleeve guide 610, a sleeve 611, and a valve 607 for injecting gas into the chamber 603. However, the noise generation device 600 does not include a reservoir of gas. Instead, the noise generation device 600 is configured to be supplied with gas via a gas fitting 660 in line with the valve 607. The gas fitting 660 is configured to receive a supply of gas from a separate reservoir. In this embodiment, the noise generation device 600 is in the form of a gun attachment shaped to appear like a flashlight.

Figure 15:
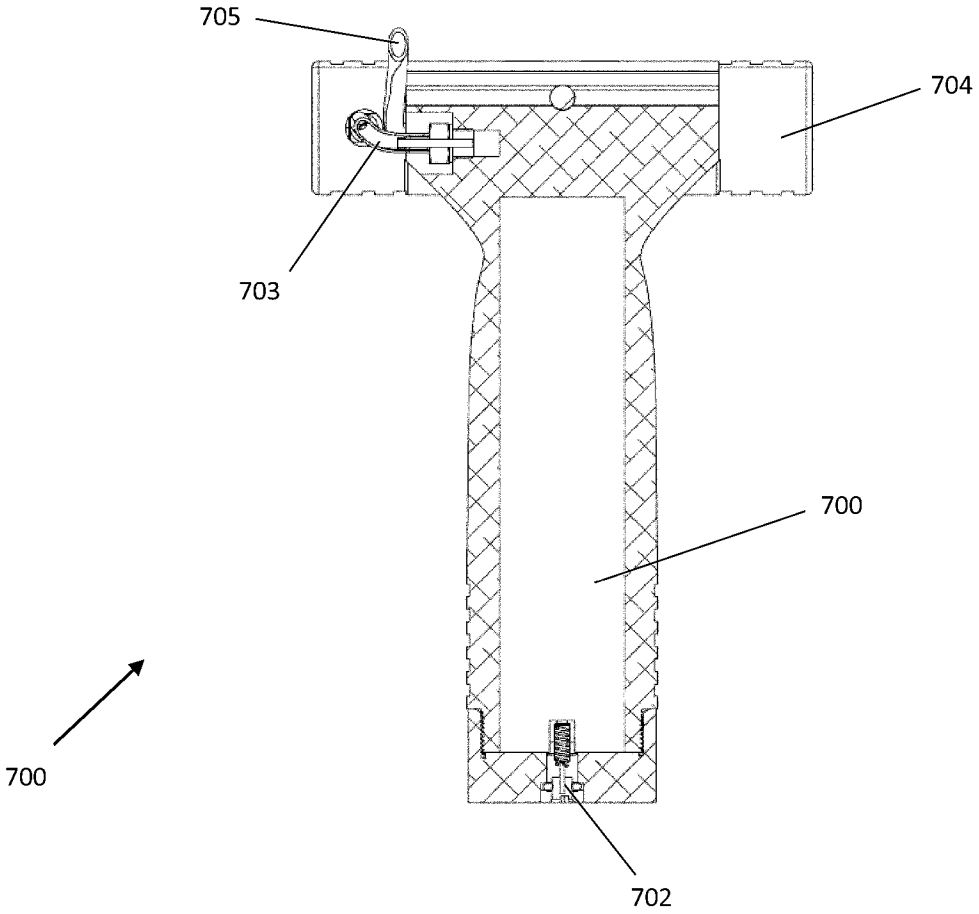
FIG. 15 is a cross-section view illustration of a foregrip comprising a reservoir for use with the noise generation device of FIG. 14.

FIG. 15 shows a cross section view of a foregrip 700 for a gun, such as a simulation weapon. The foregrip 700 comprises a reservoir 702 in the form of a hollow cavity. The reservoir 702 is fillable with a combustible gas by a port 701 at the lower end of the foregrip 700. The foregrip 700 comprises a first conduit 703 between the reservoir 702 and a regulator 704, and then a second conduit to provide gas from the regulator 704 to the gas fitting 660 of the noise generation device 600. This embodiment may be advantageous for users who would prefer to use a foregrip rather than mount the noise generating device 300 along the underside of their gun.

Other Features

With reference to FIGS. 1 and 2, in which the body 109 that is included the preferred embodiment of the invention is shown, the noise generation device 100 may comprise a controller 118 to control operation of the device. The controller 118 may comprise electronic circuitry configured to control the device to operate in the manner described below. Alternatively, the controller may comprise a microprocessor or other suitable control means. The invention is not limited by the manner in which the operation of the device is controlled.

The controller 118 triggers operation of the noise generation device 100 in response to a received signal. The received signal may be generated externally to the noise generation device, or by the device itself.

In one embodiment, the noise generation device comprises means for receiving an input signal from an external source. The signal may be received by a wired connection, for example by connection of an electrical connection to an input port on the noise generation device, or by a wireless connection, for example by means of a RF, Bluetooth or Infrared signal.

Operation of the noise generation device may occur in response to the detection of a voltage drop in a power supply to the device from an external power source, and the noise generation device controller 118 may comprise means to detect such a voltage drop. In the case of a noise generation device that is configured to operate with a recreational combat sports gun such as an airsoft or paintball gun, the device may comprise a power input port to connect to the power supply of the gun and means to detect a voltage drop in that power supply, which may, in the case of a typical recreational sports gun, result from firing of the gun.

In some embodiments the noise generation device may be triggered in response to the detection of current flow from a power supply, rather than detection of a voltage drop.

In some embodiments, the noise generation device may comprises means for detecting any one or more of a voltage drop, current, acceleration, sound or other events, and is operable to trigger operation of the device as a result of detecting those events. For example, the noise generation device may comprise an accelerometer, and trigger the device upon receiving a signal from accelerometer typical of the recoil expected from the particular type of gun (e.g. typical magnitude, duration, direction etc.) to which the noise generation device is attached.

In another embodiment, for example where the noise generation device is a stand-alone device, the signal to trigger operation of the device is generated by the device itself. The device may comprise a trigger, button or other activation mechanism to activate the device. A trigger 119 is illustrated in FIGS. 1 and 2 and, while this trigger may be present in some embodiments for purely aesthetic reasons (for example, to replicate the look of a gun accessory such as a grenade launcher), in other embodiments it may function to trigger operation of the device.

Noise generation device 100 may comprise an attachment mechanism for connecting the device to another device. For example, the device 100 may be configured to be connected to a paintball gun, airsoft gun, laser tag gun or a 'real' gun. Any suitable mechanism for attachment of the noise generation device to another device may be provided but in the embodiment of FIGS. 1 and 2, the body portion 109 (which is the body portion of the preferred embodiment) comprises a slide rail 119 on its upper surface which is adapted to slide onto a part of a gun in a mating arrangement.

Figure 3:
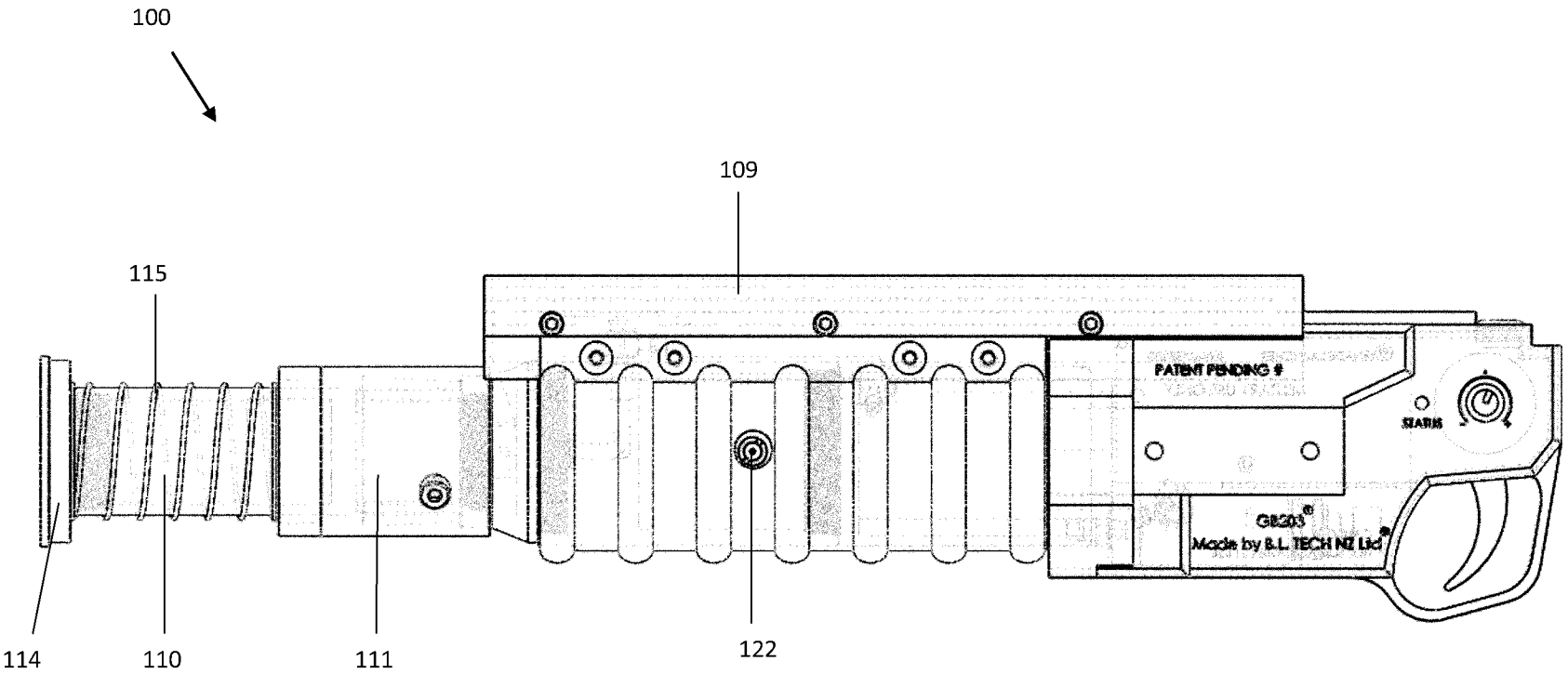
FIG. 3 is a side view illustration of the noise generation device of FIGS. 1 and 2.
Figure 4:
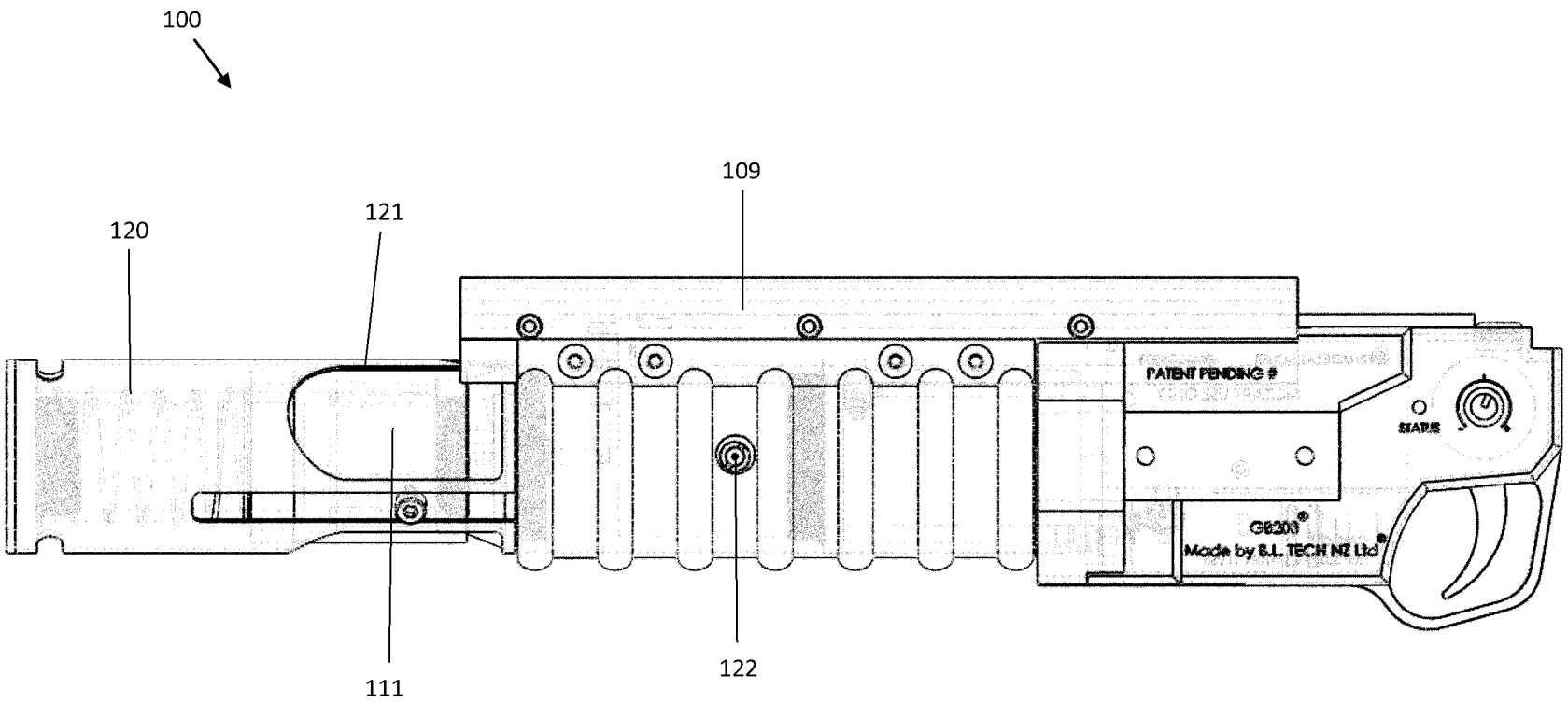
FIG. 4 is another side view illustration of the noise generation device of FIGS. 1 and 2.

FIGS. 3 and 4 are side view illustrations of the noise generation device of FIGS. 1 and 2. The features introduced with reference to FIGS. 3 and 4, while described in the context of the alternative embodiment shown in FIGS. 1 and 2, may also be present in the preferred embodiment of the invention. In FIG. 3, the sleeve guide 110, spring 115 and sleeve 111 are visible while in FIG. 4, a guard 120 is shown in position over these components. Guard 120 covers the moving components of the device to help reduce the risk of harm to users, e.g. from fingers being caught between the sleeve 111 and stopping flange 114. Guard 120 comprises one or more openings 121 at the end proximate the body portion 109 of the noise generation device such that it does not restrict the flow of ambient air into the chamber when the sleeve 111 is in the open position.

The noise generation device may be designed to visually simulate the appearance of part of a gun or a gun accessory. In the case of the embodiment of FIGS. 3 and 4, for example, the device is designed to replicate a M203 grenade launcher. This helps to add realism to the use of the device with a gun, which may be desirable to those participating in recreational combat sports or taking part in army training courses, for example.

Also illustrated in FIGS. 3 and 4, the noise generation device 100 may comprise a sealable port 122 to the gas reservoir 101. This can be used to re-fill the reservoir 101 when the supply of combustible material is running low. The port 122 may comprise a suitable valve mechanism to allow re-filling without loss of gas to the surrounding air.

The noise generation device may comprise means for disabling operation of the device if the temperature inside the combustion chamber, i.e. chamber 103 or 203, exceeds a predetermined temperature limit. In some embodiments, a temperature sensor is positioned inside chamber 203 and is operably connected to controller 118 such that the controller compares the detected temperature with a predetermined limit and does not allow the device to fire if the limit is exceeded. In one embodiment the temperature sensor is a thermistor. The temperature limit may be approximately 50° C. If the temperature in chamber 203 exceeds this temperature, the solenoid valve and electronic cabling may not operate correctly, and the gas may expand to such an extent that the spark cannot generate the desired explosion. If the temperature is too high, parts of the device may also be too hot to touch.

Operation of the Noise Generation Device

An exemplary operation of the noise generation device of the preferred embodiment will now be described with reference to the Figures.

A supply of combustible material, such as propane gas is injected into reservoir 101 through port 122. The device is then ready for 'firing'. The term 'firing' will be used in this specification when referring to a noise generation device according to the invention for the action of generating a noise through operation of the device.

The device may be fired in a number of ways. As discussed above, the controller 118 may receive a signal indicating that the device is to be fired from an external source (e.g. detecting the voltage drop in a power source of a gun attached to the noise generation device) or from an internal source (e.g. a user pushing a button on the noise generation device). In either case, the controller 118 causes gas to be injected into the sealed chamber 203, the sleeve 211 being in the sealed position abutting the side of body portion 109 to seal the chamber. The controller 118 opens solenoid valve 102 for sufficient time to inject the required amount of gas into the chamber 203, the gas being injected into the chamber at the pressure set by the gas regulator 105.

The noise generation device, simulation weapon, or gun attachment, as the case may be, may comprise a receiver for receiving a signal to cause a trigger assembly to trigger ignition of the combustible gas and operate the device. In embodiments in which the device is a gun attachment, the device may be operable to trigger combustion of the combustible gas in the chamber in response to a signal corresponding to firing of the gun.

A short time after gas has been injected into chamber 203, the controller 118 causes spark module 107 to generate a spark across the spark probes 208 inside chamber 203. The time delay between injection of gas and sparking is controlled by the controller 118 and may be approximately 10 ms. The spark that is generated causes the combustible material inside chamber 203 to combust, generating an explosion.

The explosion generates the noise that simulates a gun noise. The explosion also causes material to be pushed outwards inside chamber 203, causing combusted material to impact against the walls of the chamber. The seal 240 is energised and force is exerted on the sleeve 211, thus causing it to move away from the body portion 109.

The explosion in chamber 203 therefore causes sleeve 211 to move from the sealed position (as shown in FIG. 5) to the open position (as shown in FIG. 6). As a result, chamber 203 is opened to the ambient air and the combusted (and/or combusting) material is free to escape from the chamber. The opening of the chamber may also release some of the sound generated by the explosion, making it louder.

As the sleeve 211 moves into the open position shown in FIG. 6, spring 215 compresses. Eventually increasing expansive force exerted by the compressing spring 215 on the sleeve 211 overcomes the force of the sleeve moving into the spring and, as a result, the spring pushes sleeve 211 back towards body portion 109.

In the alternative embodiment shown in FIGS. 1 and 2, as sleeve 111 moves back towards body portion 109, the attractive force between the magnets 116 and 117 pulls the sleeve 111 back into the sealed position shown in FIG. 1.

It will be understood that, for the noise generation device, according to the alternative embodiment of FIGS. 1 and 2, to operate in the manner described, the force of the explosion (determined by the size of chamber 103 and the amount and/or pressure of combustible gas injected into it), the attractive force between magnets 116 and 117, and the stiffness of the spring 115 need to be selected to balance appropriately. For example, the magnetic force of attraction between magnetic members 116 and 117 should be configured to be sufficiently strong to hold the sleeve 111 in the sealed position against the force of gravity, or against a jolt on the device that may occur through normal use (e.g. if the device is dropped or banged against another object), and strong enough to pull the sleeve 111 back into position having recoiled off spring 115, but weak enough that an explosion in chamber 103 causes sleeve 111 to slide along sleeve guide 110 against the attractive magnetic force. Also the spring 115 needs to be of sufficient stiffness to allow the sleeve 111 to move far enough away from body 109 following an explosion in chamber 103 such that the chamber is open to the ambient air, while ensuring sleeve 111 is pushed back towards body 109 having bounced off the spring.

Referring again to the preferred embodiment, following an explosion in chamber 203, sleeve 211 preferably moves sufficiently far away from body 109 that the chamber is opened wide so that the combusted/combusting material can exit the chamber and fresh air can enter the chamber. This ensures that, when the chamber is again sealed and is ready for next firing, further injection of combustible gas into the chamber by the valve will result in the desired amount of combustible gas is present for a successful firing. If not enough gas can exit the chamber following one firing then there may be too much gas in the chamber following the next injection for a subsequent successful firing. By operating in this way, the noise generation device is able to be repeatedly successfully fired, and in quick succession.

In one alternative embodiment of the invention, the spring is configured such that, it exerts a force on the sleeve towards the body position even when the sleeve is in the sealed position. In this embodiment, magnets are not used since the force of the spring holds the sleeve in place even when the device is pointed downwards or jolted. In this embodiment, a significant force of the explosion may be needed to open the sleeve widely enough for the air inside the chamber to refresh after firing.

In one alternative embodiment of the invention, the sleeve is caused to open at the same time as, or shortly after, a spark is generated in the chamber. That is, the device comprises a mechanism to open the sleeve and the sleeve is not opened (or is not solely opened) by the force of the explosion.

Embodiments of the invention may provide an easily portable noise generation device that creates a realistic sounding gun noise. The device contains its own fuel supply, which can last for sufficient number of fires to be useful in a battle simulation or recreational combat game. The mechanism of the device automatically primes itself ready for the next firing.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavour in any country in the world.

The invention may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

The invention claimed is:

1. A noise generation device comprising:

a housing defining a chamber, the housing comprising a wall member moveable between a sealed position and an open position, wherein in the sealed position the chamber is fluidly sealed and in the open position the chamber is open;

an injection assembly for injecting combustible material into the chamber;

a triggering assembly for triggering the combustible material to combust inside the chamber to generate a noise;

wherein the moveable wall member comprises a sleeve adapted to slide longitudinally, between the sealed position and the open position, along a sleeve guide spaced from a body portion, and wherein in the sealed position the sleeve abuts the body portion and spans the space between the body portion and the sleeve guide such that the chamber is defined at least by the sleeve guide, the sleeve and the body portion, and in the open position the sleeve is spaced from the body portion to open the chamber;

wherein the noise generation device is configured such that the moveable wall member moves from the sealed position to the open position on combustion of the material inside the chamber to allow material to exit the chamber.

2. The noise generation device of claim 1, wherein combustion of the combustible material pushes the moveable wall member to move from the sealed position to the open position, and the noise generation device comprises a return mechanism to move the moveable wall member back to the sealed position from the open position.

3. The noise generation device of claim 1, wherein the noise generation device comprises a body seal member attached to, or mounted on, the body portion, and configured to seal with the sleeve when the sleeve is in the sealed position.

4. The noise generation device of claim 3, wherein the body seal member comprises a flange configured to be energised and seal against the inside of the sleeve as a result of an increase in pressure inside the chamber.

5. The noise generation device of claim 1, wherein the noise generation device comprises a sleeve seal member attached to, or mounted in, the sleeve, and configured to seal with the sleeve guide when the sleeve is in the sealed position.

6. The noise generation device of claim 5, wherein the sleeve seal member comprises a slit which enables the sleeve seal member to expand and contract while maintaining a seal with the sleeve guide.

7. The noise generation device of claim 1, wherein the sleeve guide comprises a tapered outer surface configured to reduce the friction between the sleeve guide and the sleeve as the sleeve moves towards the open position.

8. The noise generation device of claim 7, wherein the sleeve guide comprises a first cylindrical portion around which the sleeve seal forms a sufficiently tight seal in the sealed position, a second cylindrical portion over which the sleeve seal is able to slide when the sleeve seal is near the open position, and a tapered portion between the first cylindrical portion and the second cylindrical portion.

9. The noise generation device of claim 1, wherein the injection assembly comprises a conduit connected or connectable to a reservoir of combustible material, and a valve openable to allow at least a portion of the combustible material to enter the chamber.

10. The noise generation device of claim 1, wherein the triggering assembly comprises a spark module connected to electrodes extending into the chamber, the spark module configured to provide a voltage across the electrodes to generate a spark within the chamber to trigger combustion of the combustible material.

11. The noise generation device of claim 1, wherein the noise generation device comprises a pump operable to remove gas from the chamber.

12. The noise generation device of claim 1, wherein the noise generation device comprises a gas bottle connected to a gas fitting of the noise generation device, and the injection assembly is configured to receive combustible material from the gas bottle.

13. A gun attachment operable to simulate the noise of a gun, the gun attachment comprising:

a housing defining a sealed chamber, the housing comprising a wall member moveable between a sealed position and an open position, wherein in the sealed position the chamber is fluidly sealed and in the open position the chamber is open;

an injection assembly for injecting combustible material into the chamber;

a triggering assembly for triggering the combustible material to combust inside the chamber to generate a noise;

wherein the moveable wall member comprises a sleeve adapted to slide longitudinally, between the sealed position and the open position, along a sleeve guide spaced from a body portion, and wherein in the sealed position the sleeve abuts the body portion and spans the space between the body portion and the sleeve guide such that the chamber is defined at least by the sleeve guide, the sleeve and the body portion, and in the open position the sleeve is spaced from the body portion to open the chamber;

wherein the gun attachment is configured to allow exhaust material to exit the chamber after combustion, in that the moveable wall member moves from the sealed position to the open position on combustion of the material inside the chamber to allow material to exit the chamber; and wherein the gun attachment is configured for attachment to a gun.

14. The gun attachment of claim 13, wherein the triggering assembly comprises a receiver for receiving a signal corresponding to firing of the gun, the signal triggering operation of the gun attachment.

15. The gun attachment of claim 14, wherein the received signal is in the form of one or more of a voltage drop, a current flow, a sound, or an acceleration.

16. A simulation weapon, comprising:

a housing defining a sealed chamber, the housing comprising a wall member moveable between a sealed position and an open position, wherein in the sealed position the chamber is fluidly sealed and in the open position the chamber is open;

an injection assembly for injecting combustible material into the chamber;

a triggering assembly for triggering the combustible material to combust inside the chamber to generate a noise;

wherein the moveable wall member comprises a sleeve adapted to slide longitudinally, between the sealed position and the open position, along a sleeve guide spaced from a body portion, and wherein in the sealed position the sleeve abuts the body portion and spans the space between the body portion and the sleeve guide such that the chamber is defined at least by the sleeve guide, the sleeve and the body portion, and in the open position the sleeve is spaced from the body portion to open the chamber;

wherein the simulation weapon is configured to allow exhaust material to exit the chamber after combustion, in that the moveable wall member moves from the sealed position to the open position on combustion of the material inside the chamber to allow material to exit the chamber.

17. The simulation weapon of claim 16, wherein the chamber is located within a barrel portion of the simulation weapon.

18. The simulation weapon of claim 17, wherein the injection assembly, the triggering assembly, and a reservoir of combustible material are located within the barrel portion of the simulation weapon.

19. The simulation weapon of claim 16, wherein the simulation weapon comprises a laser device configured for use in a laser training system, and the triggering assembly triggers the combustible material to combust when the laser device is operated, to produce a noise.

* * * * *